US009042748B2

(12) United States Patent
Urayama et al.

(10) Patent No.: US 9,042,748 B2
(45) Date of Patent: May 26, 2015

(54) IMAGE FORMING APPARATUS

(71) Applicants: Taichi Urayama, Kanagawa (JP); Ryuji Yoshida, Kanagawa (JP); Tomoko Takahashi, Kanagawa (JP); Shotaro Hoshi, Kanagawa (JP); Hiroyuki Sugiyama, Kanagawa (JP); Ryusuke Mase, Kanagawa (JP); Masahiko Shakuto, Kanagawa (JP); Takamasa Ozeki, Kanagawa (JP); Hideki Zemba, Kanagawa (JP); Yoshinori Nakagawa, Kanagawa (JP)

(72) Inventors: Taichi Urayama, Kanagawa (JP); Ryuji Yoshida, Kanagawa (JP); Tomoko Takahashi, Kanagawa (JP); Shotaro Hoshi, Kanagawa (JP); Hiroyuki Sugiyama, Kanagawa (JP); Ryusuke Mase, Kanagawa (JP); Masahiko Shakuto, Kanagawa (JP); Takamasa Ozeki, Kanagawa (JP); Hideki Zemba, Kanagawa (JP); Yoshinori Nakagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/276,082

(22) Filed: May 13, 2014

(65) Prior Publication Data

US 2014/0341597 A1 Nov. 20, 2014

(30) Foreign Application Priority Data

May 14, 2013 (JP) ..... 2013-101884

(51) Int. Cl.

*G03G 15/06* (2006.01)
*G03G 15/08* (2006.01)
*G03G 15/00* (2006.01)

(52) U.S. Cl.

CPC ..... *G03G 15/0824* (2013.01); *G03G 15/065* (2013.01); *G03G 15/5054* (2013.01); *G03G 15/5058* (2013.01); *G03G 2215/0607* (2013.01); *G03G 15/0849* (2013.01)

(58) Field of Classification Search

CPC ..... G03G 15/065; G03G 15/0844; G03G 15/0887

See application file for complete search history.

(56) References Cited

U.S. PATENT DOCUMENTS

| | | | |
|---|---|---|---|
| 2004/0042822 | A1 | 3/2004 | Fujishiro et al. |
| 2005/0154562 | A1 | 7/2005 | Matsuura et al. |
| 2005/0157327 | A1 | 7/2005 | Shoji et al. |
| 2005/0238384 | A1 | 10/2005 | Sampe et al. |
| 2005/0281596 | A1 | 12/2005 | Nakagawa et al. |
| 2005/0286916 | A1 | 12/2005 | Nakazato et al. |
| 2006/0127131 | A1 | 6/2006 | Fujishiro et al. |
| 2006/0182451 | A1 | 8/2006 | Shoji et al. |

(Continued)

FOREIGN PATENT DOCUMENTS

| | | |
|---|---|---|
| JP | 05-341627 | 12/1993 |
| JP | 2007-322634 | 12/2007 |

(Continued)

*Primary Examiner* — Gregory H Curran

(74) *Attorney, Agent, or Firm* — Oblon, McClelland, Maier & Neustadt, L.L.P.

(57) ABSTRACT

An image forming apparatus includes a latent image carrier to carry a latent image on a surface thereof, a developing device to develop the latent image with toner to form a toner image on the surface of the latent image carrier, a transfer unit to transfer the toner image onto a recording medium, and a controller. The controller executes an image density adjustment control of adjusting a developing bias to obtain a target image density. The controller further executes a forced toner consumption control of forcibly consuming the toner contained in the developing device by attaching the toner to the latent image carrier to form a toner pattern on the surface of the latent image carrier. The controller executes the forced toner consumption control to forcibly consume a smaller amount of toner in response to a higher developing bias as adjusted by the image density adjustment control.

15 Claims, 15 Drawing Sheets

(56) References Cited

U.S. PATENT DOCUMENTS

| | | | | |
|---|---|---|---|---|
| 2007/0127934 | A1 | 6/2007 | Shoji et al. | |
| 2008/0003017 | A1 | 1/2008 | Fujishiro et al. | |
| 2009/0052912 | A1 | 2/2009 | Soji et al. | |
| 2010/0266296 | A1* | 10/2010 | Ochiai | 399/27 |
| 2012/0045235 | A1 | 2/2012 | Shiori et al. | |
| 2012/0057891 | A1* | 3/2012 | Ishikura et al. | 399/55 |

FOREIGN PATENT DOCUMENTS

| | | |
|---|---|---|
| JP | 2008-224827 | 9/2008 |
| JP | 2010-117636 | 5/2010 |
| JP | 2011-170104 | 9/2011 |
| JP | 2012-113249 | 6/2012 |
| JP | 2012-226279 | 11/2012 |

* cited by examiner

| EXAMPLE | |
|---|---|
| DEVELOPING BIAS (−V) | TONER AMOUNT (mg) |
| 350 | 800 |
| 450 | 600 |
| 550 | 400 |
| 650 | 200 |
| 750 | 50 |
| 800 | 25 |
| 850 | 0 |

FIG. 11

| | DEVELOPING BIAS (ABSOLUTE VALUE) AFTER IMAGE DENSITY ADJUSTMENT CONTROL | TONER AMOUNT | EVALUATION A | EVALUATION B |
|---|---|---|---|---|
| EXAMPLE 1 | 350V | 800mg | 1 | 4 |
| EXAMPLE 2 | 620V | 260mg | 1 | 3 |
| EXAMPLE 3 | 740V | 70mg | 1 | 2 |
| EXAMPLE 4 | 750V | 50mg | 1 | 2 |
| COMPARATIVE EXAMPLE 1 | 350V | 400mg | 3 | 4 |
| COMPARATIVE EXAMPLE 2 | 600V | 100mg | 2 | 3 |

FIG. 18

| | $0 < (\gamma - \gamma_{th}) < 0.1$ | $0.1 \leq (\gamma - \gamma_{th}) < 0.2$ | $0.2 \leq (\gamma - \gamma_{th})$ |
|---|---|---|---|
| CORRECTION FACTOR A | A1 | A2 | A3 |

FIG. 19

| | $0 \leq (Vk - Vk_{th}) < 30V$ | $30V \leq (Vk - Vk_{th}) < 60V$ | $60V \leq (Vk - Vk_{th}) < 90V$ | $90V \leq (Vk - Vk_{th})$ |
|---|---|---|---|---|
| CORRECTION FACTOR B | B1 | B2 | B3 | B4 |

IMAGE FORMING APPARATUS

CROSS-REFERENCE TO RELATED APPLICATION

This patent application is based on and claims priority pursuant to 35 U.S.C. §119 to Japanese Patent Application No. 2013-101884, filed on May 14, 2013, in the Japan Patent Office, the entire disclosure of which is hereby incorporated by reference herein.

BACKGROUND

1. Technical Field

Embodiments of this disclosure generally relate to an image forming apparatus such as a copier, a printer, and a facsimile machine, and more specifically, to an image forming apparatus for forming a toner image by developing a latent image on a latent image carrier with a two-component developer and transferring the toner image onto a recording medium.

2. Related Art

In typical electrophotographic image forming apparatuses, optical image data is formed as a latent image on an evenly charged latent image carrier, such as a photoconductor, and the latent image is developed with toner supplied by a developing device to form a visible toner image on the latent image carrier. The visible toner image is then transferred onto a recording medium, such as a transfer sheet, directly or indirectly via an intermediate transfer body, such as an intermediate transfer belt.

In such image forming apparatuses, impaired and insufficiently charged toner may degrade image quality with background contamination or the like. For example, with continuous printing involving few or no images, only a small amount of toner is discharged from the developing device while a large amount of toner remains in the developing device and is circulated for a long time therein. The toner deteriorates with such extended circulation. For example, an additive may be separated from the toner and buried. Such deterioration of toner may increase the viscosity of a developer and/or change charging characteristics of the toner, degrading image quality with background contamination or the like.

One approach to preventing impaired toner from degrading image quality involves forced consumption of the impaired toner contained in the developing device. Such forced consumption of impaired toner contained in the developing device decreases toner density of the developer contained in the developing device and thereby prevents background contamination due to impaired toner. However, excessive decrease in toner density may lower, and therefore degrades image density.

Forced toner consumption is typically performed when an image forming process consumes a small amount of toner contained in the developing device, which impairs the toner in the developing device. When a small amount of toner is consumed, the developing device has a relatively high toner density. Therefore, even after the forced toner consumption, the developing device keeps a sufficient toner density to obtain a desired image density.

SUMMARY

In one embodiment of this disclosure, an improved image forming apparatus includes a latent image carrier, a developing device, a transfer unit, and a controller. The latent image carrier carries the latent image on a surface thereof. The developing device contains a two-component developer including toner and carrier charged to a predetermined polarity. The developing device electrostatically attaches the toner to the latent image with a developing bias to form a toner image on the surface of the latent image carrier. The transfer unit transfers the toner image from the surface of the latent image carrier onto a recording medium. The controller executes an image density adjustment control of adjusting the developing bias to obtain a target image density at a predetermined time. The controller further executes a forced toner consumption control of forcibly consuming the toner contained in the developing device at a predetermined time by attaching the toner to the latent image carrier to form a toner pattern on the surface of the latent image carrier. The controller executes the forced toner consumption control to forcibly consume a smaller amount of toner in response to a higher developing bias as adjusted by the image density adjustment control.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein:

FIG. 11 is a table of evaluation of background contamination;

FIG. 18 is a table of a relation between the difference between a developing gamma and a reference level and a first correction coefficient;

FIG. 19 is a table of a relation between the difference between a developing potential and a reference level, and a second correction coefficient;

Figure 1:
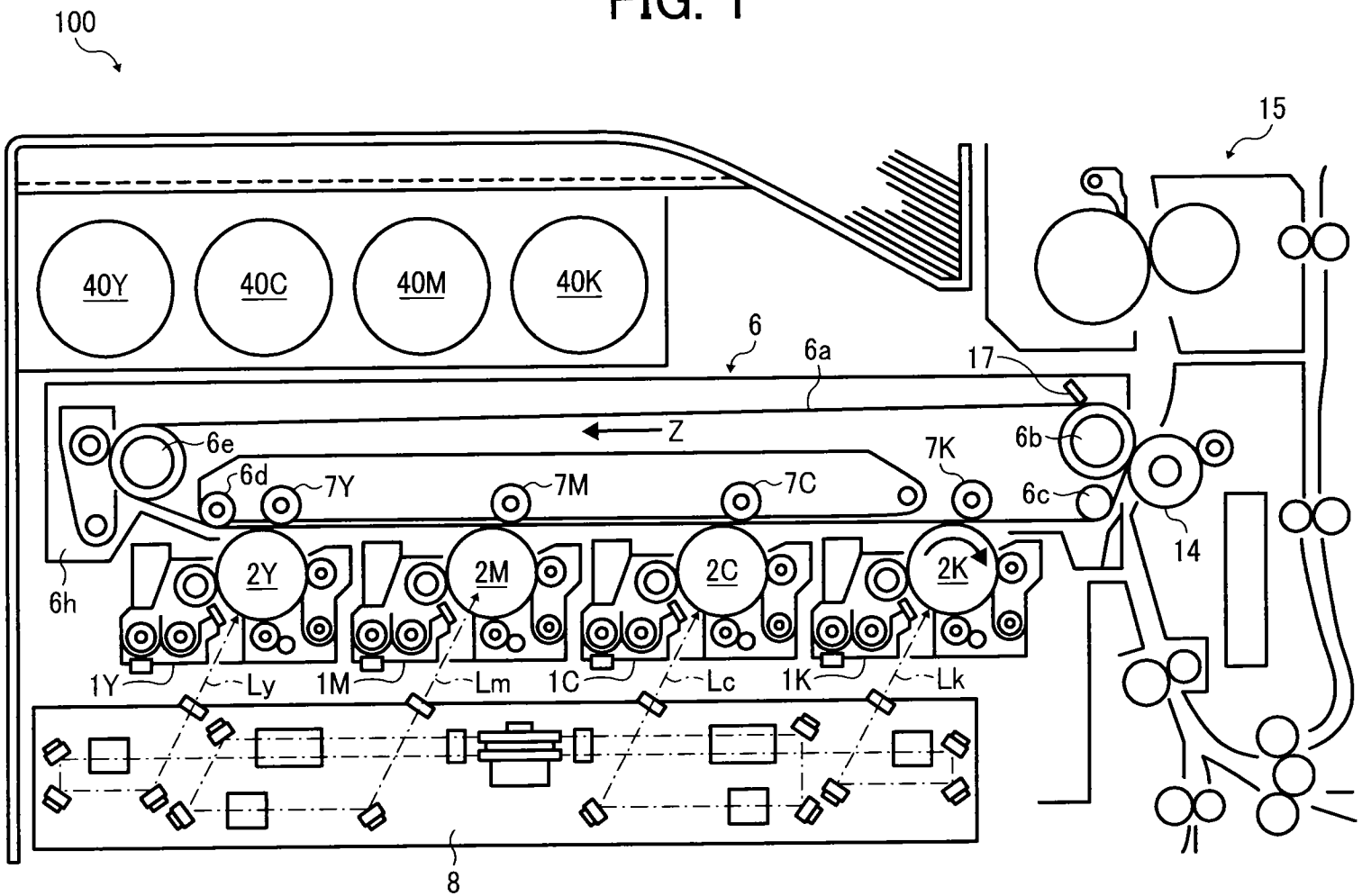
FIG. 1 is a schematic view of an image forming apparatus according to an embodiment of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals will be given to identical or corresponding constituent elements such as parts and materials having the same functions, and redundant descriptions thereof will be omitted unless otherwise required.

Referring now to the drawings, wherein like reference numerals designate identical or corresponding parts throughout the several views, embodiments of this disclosure are described below.

Figure 2:
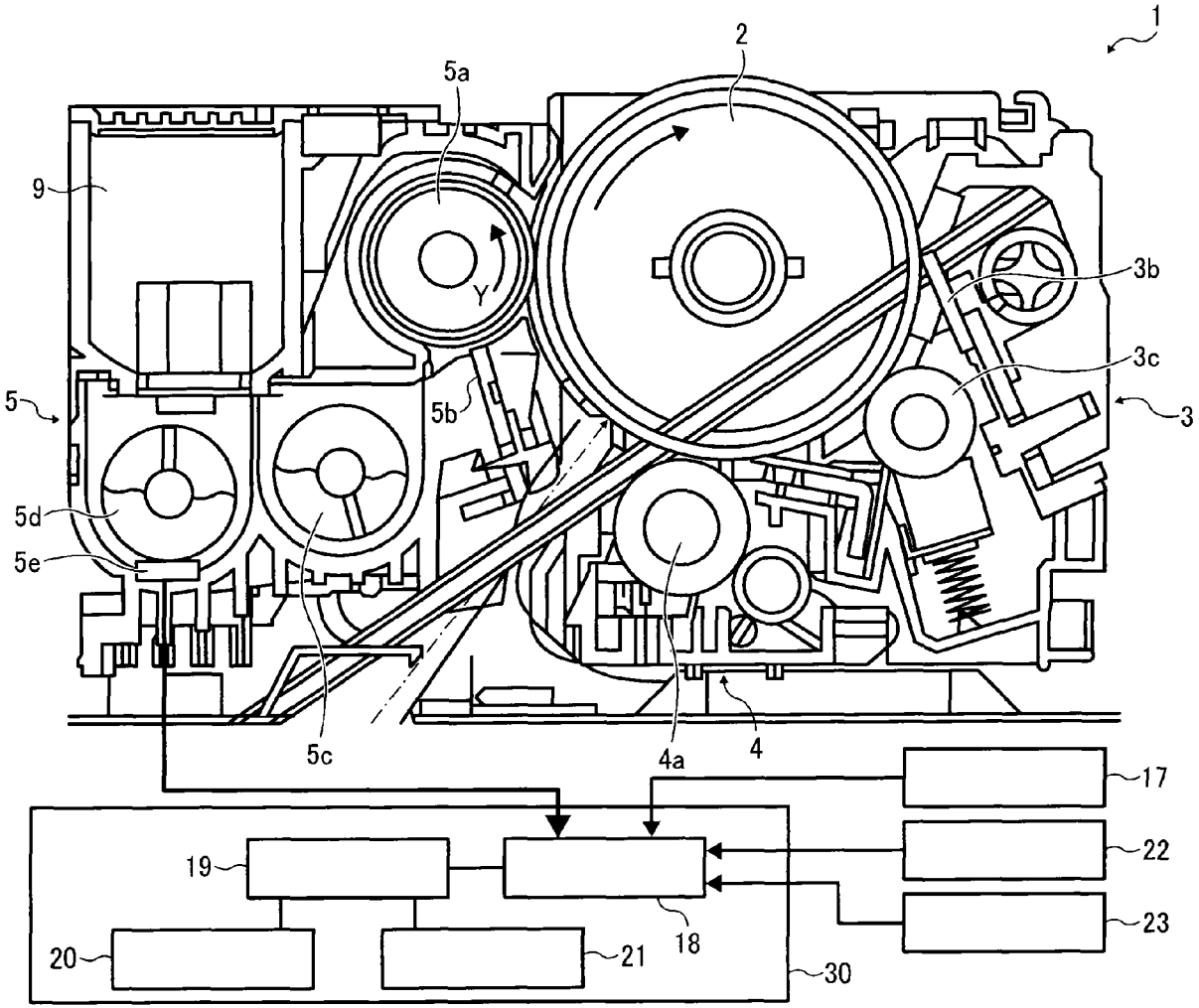
FIG. 2 is an enlarged view of an image forming station incorporated in the image forming apparatus of FIG. 1.

Initially with reference to FIGS. 1 and 2, a description is given of an image forming apparatus 100 according to an embodiment of this disclosure.

FIG. 1 is a schematic view of the image forming apparatus 100. The image forming apparatus 100 is herein an electrophotographic full-color printer. FIG. 2 is an enlarged view of an image forming station 1 incorporated in the image forming apparatus 100.

In the image forming apparatus 100, four image forming stations 1Y, 1M, 1C, and 1K are separately disposed side by side, at equal intervals, in a horizontal direction in FIG. 1. The four image forming stations 1Y, 1M, 1C, and 1K are image forming units to form toner images of yellow (Y), magenta (M), cyan (C), and black (K), respectively. It is to be noted that reference numerals that represent units, devices, members and so forth are given with suffixes Y, M, C, and Bk that denote colors of yellow, magenta, cyan, and black, respectively, when required. Otherwise, the suffixes Y, M, C, and Bk are omitted.

The four image forming stations 1Y, 1M, 1C, and 1K have identical configurations. Each of the image forming stations 1Y, 1M, 1C, and 1K includes a photoconductor 2 as a latent image carrier. The photoconductor 2 is rotated in a clockwise direction in FIG. 1 by a drive source during operation of the image forming apparatus 100. The photoconductor 2 is e.g., an aluminum cylinder having a diameter of about 30 mm to about 120 mm coated by a photoconductive, organic semiconductor layer. Alternatively, the photoconductor 2 may be a belt photoconductor.

As illustrated in FIG. 2, the photoconductor 2 is surrounded by various pieces of imaging equipment, such as a charging device 4, a developing device 5, and a cleaning device 3, sequentially disposed. The charging device 4 includes, e.g., a charging roller 4*a* as a charging member. The developing device 5 includes, e.g., a developing sleeve 5*a*, a doctor blade 5*b*, and first and second conveying screws 5*c* and 5*d*. The cleaning device 3 is a cleaner for the photoconductor 2 and includes, e.g., a cleaning blade 3*b* and a collecting screw 3*c*. As illustrated in FIG. 1, an exposure device 8 is a latent image forming device and disposed below the photoconductors 2Y, 2M, 2C, and 2K. The exposure device 8 irradiates surfaces of the photoconductors 2Y, 2M, 2C, and 2K evenly charged by the charging devices 4, with laser light Ly, Lm, Lc, and Lk, respectively, to form electrostatic latent images on the respective surfaces of the photoconductors 2Y, 2M, 2C, and 2K. Between the charging devices 4 and the developing devices 5, narrow spaces are secured in an axial direction of the photoconductors 2, respectively. The laser light Ly, Lm, Lc, and Lk emitted by the exposure device 8 passes through the narrow spaces, and reaches the respective surfaces of the photoconductors 2.

The exposure device 8 employs a laser scanning method and includes, e.g., laser light sources and polygon mirrors. Four laser diodes emit the laser light Ly, Lm, Lc, and Lk modulated according to image data to be formed. The exposure device 8 includes a metal or resin housing to accommodate optical parts and control parts. An upper surface of the housing has four emitting apertures through which the laser light Ly, Lm, Lc, and Lk is emitted. Each of the emitting apertures is provided with a translucent dust-proof member. According to this embodiment, the exposure device 8 includes one housing. Alternatively, a plurality of exposure devices 8 may be provided for the respective image forming stations 1Y, 1M, 1C, and 1K. Additionally, the exposure device 8 may employ a combination of a light-emitting diode (LED) array and an imaging device, instead of employing the laser light sources.

Thus, the electrostatic latent images are formed on the surfaces of the photoconductors 2Y, 2M, 2C, and 2K by the laser light Ly, Lm, Lc, and Lk, respectively. The developing devices 5 develop the electrostatic latent images with toner of the respective colors to form visible images, also known as toner images. Specifically, each of the developing devices 5 develops the electrostatic latent image with a two-component developer including toner and a carrier. Toner of yellow (Y), cyan (C), magenta (M), and black (K) is consumed in the developing devices 5Y, 5C, 5M, and 5K, respectively. A toner density detector, described later, detects toner density of the developer. When the toner density detector detects that the toner density is lowered, toner suppliers 9, illustrated in FIG. 2, supply the toner for the respective developing devices 5 from toner cartridges 40Y, 40M, 40C, and 40K disposed in an upper portion of the image forming apparatus 100, as illustrated in FIG. 1, that accommodate the toner of the respective colors.

As illustrated in FIG. 1, an intermediate transfer unit 6 is a transfer unit and disposed above the photoconductors 2Y, 2M, 2C, and 2K. The intermediate transfer unit 6 includes an intermediate transfer belt 6*a* serving as an intermediate transfer body, and a plurality of rollers 6*b*, 6*c*, 6*d*, and 6*e* around which the intermediate transfer belt 6*a* is stretched. Thus, the intermediate transfer belt 6*a* is supported by the plurality of rollers 6*b*, 6*c*, 6*d*, and 6*e* to form a loop. The intermediate transfer belt 6*a* is rotated in a direction indicated by arrow Z by rotation of the roller 6*b* as a drive roller. The intermediate transfer belt 6*a* is an endless belt member and disposed to contact a part of the surfaces of the photoconductors 2 after a developing process. Specifically, the intermediate transfer belt 6*a* is a belt having a base layer of resin film or rubber having a thickness of, e.g., about 50 μm to about 600 μm. The intermediate transfer belt 6*a* has resistance sufficient to electrostatically transfer the toner images from the photoconductors 2Y, 2M, 2C, and 2K onto an outer surface of the intermediate transfer belt 6*a* with a primary transfer bias applied to each of primary transfer rollers 7Y, 7M, 7C, and 7K.

The primary transfer rollers 7Y, 7M, 7C, and 7K are disposed facing the photoconductors 2Y, 2M, 2C, and 2K, respectively, in the loop defined by the intermediate transfer belt 6*a*. A belt cleaner 6*h* is a cleaner for the intermediate transfer belt 6*a* and disposed facing the roller 6*e*, outside the loop defined by the intermediate transfer belt 6*a*. The belt cleaner 6*h* removes residual toner and a foreign matter such as paper powder from the outer surface of the intermediate transfer belt 6*a*. According to this embodiment, the roller 6*e* also is a roller that applies tension to the intermediate transfer belt 6*a*. Accordingly, the roller 6*e* is movable to ensure that the intermediate transfer belt 6*a* is stretched as appropriate. The belt cleaner 6*h* is also movable in conjunction with the roller 6*e*. As illustrated in FIG. 1, an optical sensor 17 is disposed near the intermediate transfer belt 6*a*. The optical sensor 17 is a toner adhesion amount detector to detect image density of a patch for measuring density, which is formed on the outer surface of the intermediate transfer belt 6*a*.

Components associated with the intermediate transfer belt 6*a* and constructing the intermediate transfer unit 6 are supported by a common member, and removable, as a single integrated unit, from a body of the image forming apparatus 100.

A description is now given of operation of the image forming station 1Y that forms a toner image of yellow, as a representative example of the image forming stations 1M, 1C, and 1K.

The exposure device 8 irradiates the surface of the photoconductor 2Y evenly charged by the charging device 4Y with the laser light Ly corresponding to the image data emitted from the laser diode to form an electrostatic latent image on the surface of the photoconductor 2Y. The developing device 5Y develops the electrostatic latent image with toner, in this case of the color yellow, thereby forming a visible image, also known as a toner image of yellow (hereinafter referred to as a yellow toner image) on the surface of the photoconductor 2Y. Rotation of the photoconductor 2Y conveys the yellow toner image thus formed to a primary transfer area in which the yellow toner image faces the outer surface of the intermediate transfer belt 6*a*. In the primary transfer area, the yellow toner image is primarily transferred onto the outer surface of the intermediate transfer belt 6*a* by a primary transfer process performed by the primary transfer rollers 7Y.

Such an imaging process of forming a latent image, developing the latent image to form a toner image, and primarily transferring the toner image, is also sequentially performed in the image forming stations 1C, 1M, and 1K. Accordingly, the toner images of yellow, cyan, magenta, and black are transferred onto the intermediate transfer belt 6*a* while being superimposed one atop another to form a multicolor toner image on the outer surface of the intermediate transfer belt 6*a*. The cleaning device 3 removes residual toner and a foreign matter from the surface of the photoconductor 2 after the primary transfer process.

Rotation of the intermediate transfer belt 6*a* conveys the multicolor toner image thus formed to a secondary transfer area in which the multicolor toner image faces a secondary transfer roller 14. A sheet as a recording medium is also conveyed to the secondary transfer area in synchronization with the multicolor toner image formed on the intermediate transfer belt 6*a*. In the secondary transfer area, the multicolor toner image is secondarily transferred onto the sheet by a secondary transfer process performed by the secondary transfer roller 14. Then, the sheet carrying the multicolor toner image thereon is conveyed to a fixing device 15. In the fixing device 15, the multicolor toner image is fixed onto the sheet under heat and pressure. The sheet is then discharged outside the image forming apparatus 100. The belt cleaner 6*h* removes residual toner and a foreign matter from the outer surface of the intermediate transfer belt 6*a* after the secondary transfer process.

A description is now given of a configuration and operation of the developing device 5.

As illustrated in FIG. 2, the developing device 5 has a plurality of magnetic poles inside the developing sleeve 5*a* along a rotational direction thereof indicated by arrow Y. A drawing magnetic pole inside the developing sleeve 5*a* draw the developer, which is circulated in the developing device 5 by a first conveying screw 5*c*, to an outer surface of the developing sleeve 5*a*. Thus, the developing sleeve 5*a* carries the developer thereon. Then, the developer thus drawn and carried by the developing sleeve 5*a* is conveyed toward an area in which the developer faces the doctor blade 5*b* as the developing sleeve 5*a* rotates, by a magnetic field of a conveying pole inside the developing sleeve 5*a* and a frictional force generated between the developer and the outer surface of the developing sleeve 5*a*.

The developer thus conveyed partly passes through a gap formed between the doctor blade 5*b* and the developing sleeve 5*a*. Thus, the thickness of the developer carried on the developing sleeve 5*a* is regulated. The developer having a thickness thus regulated is conveyed to a developing area in which the developer faces the photoconductor 2 as the developing sleeve 5*a* rotates. A predetermined developing bias Vb is applied to the developing area to form an electric developing field in a direction in which the toner is moved to the electrostatic latent image formed on the photoconductor 2. The developing electric field allows the toner included in the developer carried by the developing sleeve 5*a* to move and adhere to the electrostatic latent image formed on the photoconductor 2. Consequently, a toner image is formed on the photoconductor 2.

The developer passing through the developing area and consuming the toner therein is separated from the outer surface of the developing sleeve 5*a* at a position herein called a developer release pole position. Then, the developer returns to the first conveying screw 5*c*. The first conveying screw 5*c* conveys the developer to a first end of the first conveying screw 5*c* in an axial direction of the developing sleeve 5*a*. The developer is then conveyed to the second conveying screw 5*d*. The second conveying screw 5*d* conveys the developer to a second end of the second conveying screw 5*d* opposite the first end of the first conveying screw 5*c* in the axial direction of the developing sleeve 5*a*. The toner supplier 9 supplies toner to the developer conveyed by the second conveying screw 5*d* as appropriate. Such toner supply recovers the toner density of the developer lowered by toner consumption during the developing process to a target toner density. Thereafter, the developer on the second end of the second conveying screw 5*d* is conveyed back to the first conveying screw 5*c*. The first conveying screw 5*c* conveys the developer to the first end of the conveying screw 5*c*. Consequently, the developer is drawn to the developing sleeve 5*a*.

A permeability sensor 5*e*, is a toner density detector and disposed at a bottom of a casing of the developing device 5, and more specifically, at a bottom near the second end of the second conveying screw 5*d*. The permeability sensor 5*e* outputs a detected value relative to the amount of magnetic carrier included in the developer existing in an area to detect (hereinafter called detection area), that is, around the second end of the second conveying screw 5*d*. The toner density of the developer is calculated according to the detected value, based on a constant amount of the developer existing in the detection area.

As illustrated in FIG. 2, the image forming apparatus 100 includes a controller 30. The controller 30 includes an input/output (I/O) board 18, a central processing unit (CPU) 19, a read-only memory (ROM) 20, and a random access memory (RAM) 21. The permeability sensor 5*e* and the optical sensor 17 are connected to the I/O board 18 via an analog-to-digital (A/D) converter.

Figure 3:
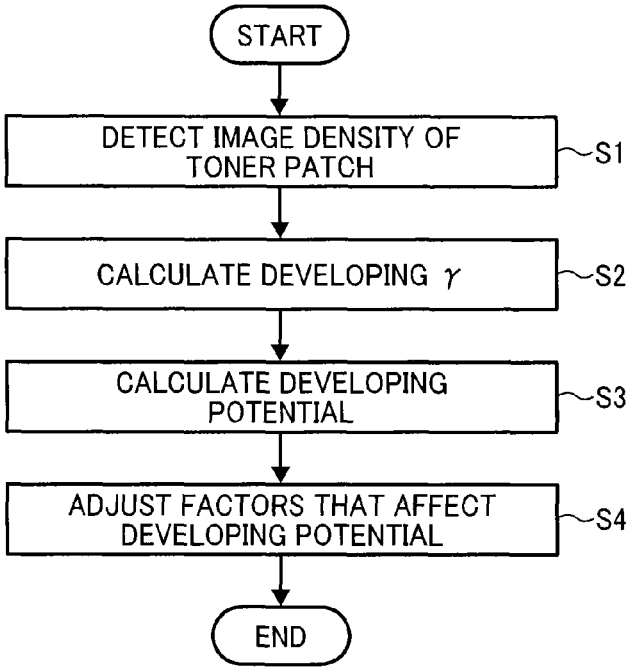
FIG. 3 is a flowchart of an image density adjustment control process according to an embodiment of this disclosure.

Referring now to FIG. 3, a description is given of an image density adjustment control process that is executed at a predetermined time to adjust image density.

FIG. 3 is a flowchart of the image density adjustment control process according to this embodiment.

In the image density adjustment control according to this embodiment, a developing potential is changed in response to a change of a developing gamma (γ). It is to be noted that the predetermined time to adjust image density is, e.g., when a power is turned on, when a mode returns to an energy-saving mode, or when an outer cover is closed.

The image density adjustment control starts with formation of a gradation pattern on each of the photoconductors 2. The gradation pattern includes 10 toner patches of different gradation levels. The 10 toner patches are formed at different developing potentials. Each of the developing potentials is obtained by changing factors that affect the developing potential, such as a target charging potential of the photoconductor 2, a developing voltage applied to the developing sleeve 5*a*, and an exposure power of the exposure device 8. According to this embodiment, each of the developing potentials is determined by changing the developing voltage (developing bias Vb) applied to the developing sleeve 5*a* and charging voltage (charging bias), which is direct current (DC) voltage in this case, applied to the charging roller 4*a* of the charging device 4, with a constant exposure power of the exposure device 8. The 10 toner patches are formed sequentially from a patch having a lowest developing potential to one having the highest. The gradation pattern formed on each of the photoconductors 2 is transferred onto the intermediate transfer belt 6*a*. The optical sensor 17 detects image density of the toner patches of the gradation pattern for each color (S1).

Figure 4:
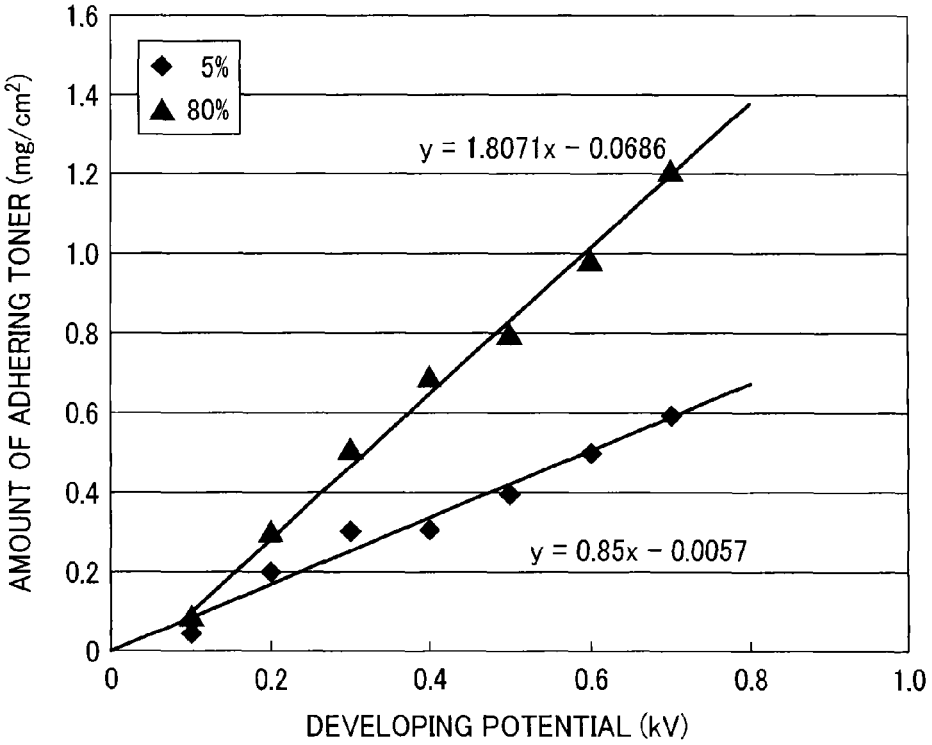
FIG. 4 is a graph showing a linear approximation of a relation between an amount of adhering toner and developing potential obtained by image density adjustment control.

In the present embodiment, the optical sensor 17 is a reflective optical sensor that measures an amount of light reflected by the toner patches and detects the image density according to a detected amount of light. An output value Vs of the optical sensor 17 is transmitted to the controller 30. The controller 30 converts the output value Vs to an amount of adhering toner ($mg/cm^2$) corresponding to the image density of each toner patch. In FIG. 4, the straight line indicates linear approximation of a relational function of a relation between the amount of adhering toner ($mg/cm^2$) and the developing potential (kV) obtained by the image density adjustment control. The gradient of the relational expression denotes a developing γ ($mg/cm^2/kV$) that indicates the developing capability. After the developing γ is calculated as described above (S2), a developing potential is calculated to obtain a predetermined amount of adhering toner (S3). The factors that affect the developing potential, such as the developing voltage, are then adjusted to reach the developing potential thus calculated (S4). Thus, the image density is adjusted.

According to this embodiment, each of the gradation patterns has 10 toner patches of different gradation levels to measure the developing capability γ. Alternatively, each of the gradation patterns may have a lower number of toner patches of different gradation levels. Although the linear approximation can be performed on a gradation pattern having at least three gradation levels to obtain the above-described relational expression, preferably the gradation pattern is formed with four or more gradation levels to minimize errors.

Figure 5:
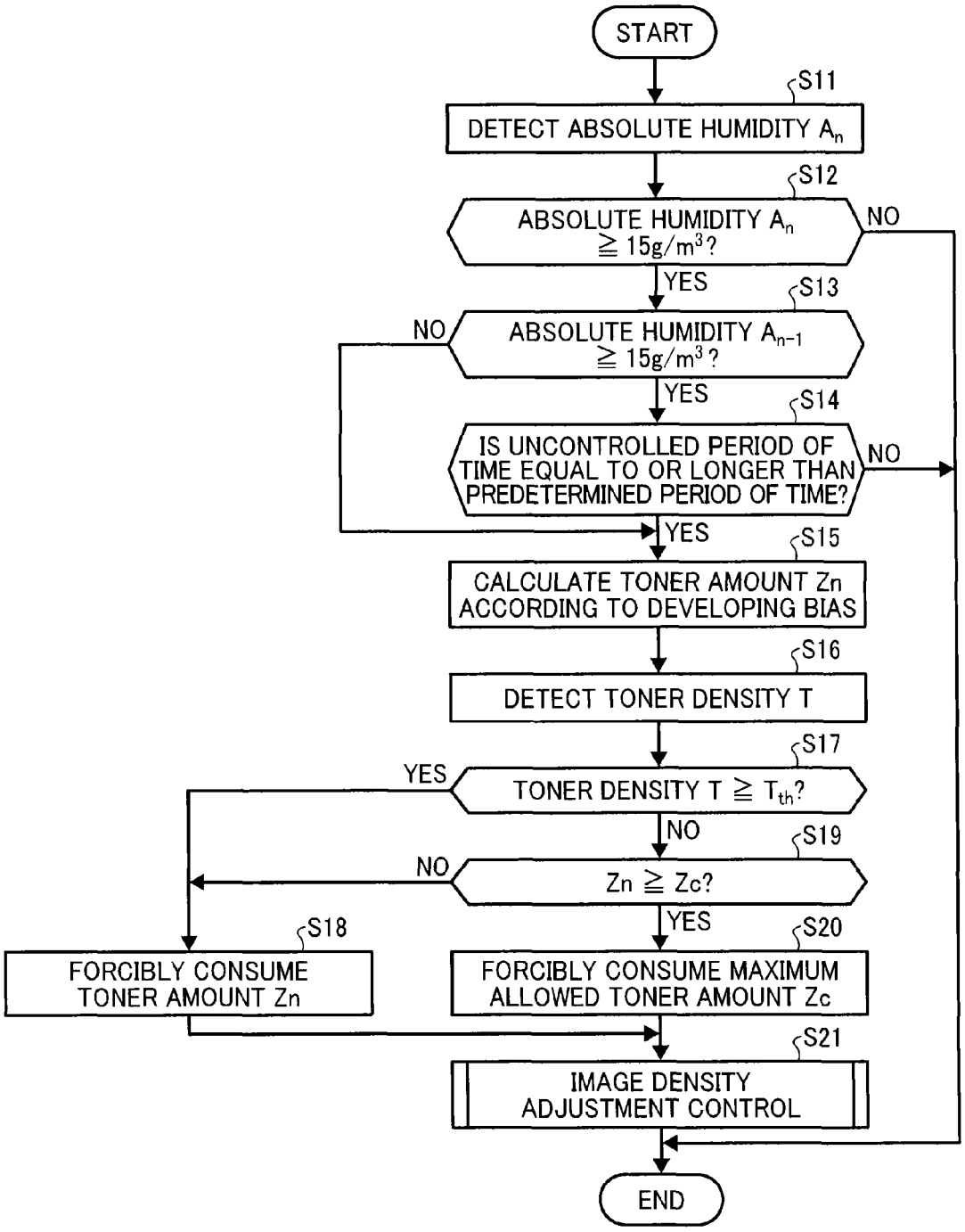
FIG. 5 is a flowchart of a forced toner consumption control process according to an embodiment of this disclosure.

Referring now to FIG. 5, a description is given of a forced toner consumption control process.

By the forced toner consumption control, the toner is moved from the developing devices 5 and attached to the respective photoconductors 2 at a predetermined time. Thus, the toner contained in the developing devices 5 is forcibly consumed. However, unlike typical forced toner consumption, the forced toner consumption control according to this embodiment is executed when the toner is insufficiently charged in the developing devices 5 in a high-temperature, high-humidity environment, in which background contamination is likely to occur.

Generally, when toner is insufficiently charged, the toner may be attached to a portion of the latent image carrier where a latent image is not formed, herein called a background. Thus, the background is contaminated. The toner may be insufficiently charged by deterioration of toner as described above or in a high-temperature, high-humidity environment, which may remove the electric charge from toner. Accordingly, in the high-temperature, high-humidity environment, the toner may be insufficiently charged even if the developing devices 5 does not contain a relatively large amount of impaired toner, resulting in background contamination of the output image.

Therefore, forced consumption of the insufficiently charged toner is effective to prevent background contamination as such forced consumption decreases the toner density in the developing devices 5 and facilitates frictional charging of individual toner particles with the carrier particles. As a result, the toner is sufficiently charged, preventing background contamination even in the high-temperature, high-humidity environment.

However, when starting the forced toner consumption in a high-temperature, high-humidity environment, the toner density in the developing device varies depending on the image forming processes performed before the forced toner consumption. For example, the toner density may be relatively low when starting the forced toner consumption. In such a case, typical forced toner consumption may excessively decrease the toner density in the developing device, causing insufficient image density.

In addition, forced toner consumption may be performed along with toner supply to prevent decrease in the toner density in the developing device. However, the charge on the new toner supplied is usually lower than that of the residual toner in the developing device. Therefore, supplying such toner in the high-temperature, high-humidity environment may hamper frictional charging of individual toner particles with the carrier particles and the charge on the toner is not recovered. Accordingly, the forced toner consumption along with toner supply may cause or worsen background contamination.

As described above, when the toner is insufficiently charged in the developing device, for example, in a high-temperature, high-humidity environment, the image quality is degraded because of e.g., background contamination.

According to this embodiment, the forced toner consumption control is executed without excessively decreasing the toner density in the developing devices 5, by discharging a relatively large amount of toner insufficiently charged from the developing devices 5. As a result, background contamination is prevented and a desired image density can be obtained.

It is to be noted that the forced toner consumption control can be executed at any appropriate time. In an example described below, the forced toner consumption control is executed after the image density adjustment control and before the subsequent image forming process.

FIG. 5 is a flowchart of the forced toner consumption control process.

The forced toner consumption control starts with detection of a current absolute humidity $A_n$ according to detection data from, e.g., a temperature sensor 22 and a humidity sensor 23 incorporated in the image forming apparatus 100 (S11). In the present embodiment, it is determined whether the current absolute humidity $A_n$ is 15 g/m$^3$ or greater (S12). If it is determined that the current absolute humidity $A_n$ is less than 15 g/m$^3$ (No in S12), then the control ends without performing forced toner consumption. It is to be noted that a threshold of the current absolute humidity $A_n$, which is used for determining whether to perform the forced toner consumption, is not limited to 15 g/m$^3$ as long as it is set as appropriate.

On the other hand, if it is determined that the current absolute humidity $A_n$ is 15 g/m$^3$ or greater (Yes in S12), then it is determined whether a previous absolute humidity $A_{n-1}$, which is detected by the image density adjustment control, is 15 g/m$^3$ or greater (S13). If it is determined that the previous absolute humidity $A_{n-1}$ is less than 15 g/m$^3$ (No in S13), then the forced toner consumption is performed. The forced toner consumption is performed because it is not performed upon the image density adjustment control previously performed.

If it is determined that the previous absolute humidity $A_{n-1}$ is 15 g/m$^3$ or greater (Yes in S13), then it is determined whether a period of time during which image formation is not performed (hereinafter referred to as an uncontrolled period of time) is equal to or longer than a predetermined period of time (S14). If it is determined that the uncontrolled period of time is shorter than the predetermined period of time (No in S14), then the control ends without performing the forced toner consumption. The forced toner consumption is not performed at this time because the toner is forcibly consumed upon the image density adjustment control performed previously, and the uncontrolled period of time is relatively short. If the charge on the toner is recovered by the forced toner consumption upon the image density adjustment control performed previously, even in a high-temperature, high-humidity environment, background contamination can be prevented without performing the forced toner consumption this time when the uncontrolled period of time is relatively short.

By contrast, if it is determined that the uncontrolled period of time is equal to or greater than the predetermined period of time (Yes in S14), then the forced toner consumption is performed.

As described above, according to this embodiment, the forced toner consumption is performed (S15 to S20) when the image density adjustment control is executed at a predetermined time when the current absolute humidity $A_n$ is 15 g/m$^3$ or greater (Yes in S12), the previous absolute humidity $A_{n-1}$ is also 15 g/m$^3$ or greater (Yes in S13), and the uncontrolled period of time is equal to or greater than the predetermined period (Yes in S14).

In addition, according to this embodiment, the forced toner consumption is performed (S15 to S20) when the image density adjustment control is executed at a predetermined time when the current absolute humidity $A_n$ is 15 g/m$^3$ or greater (Yes in S12), and the previous absolute humidity $A_{n-1}$ is less than 15 g/m$^3$ (No in S13).

A description is now given of detailed operation of the forced toner consumption.

Figure 6:
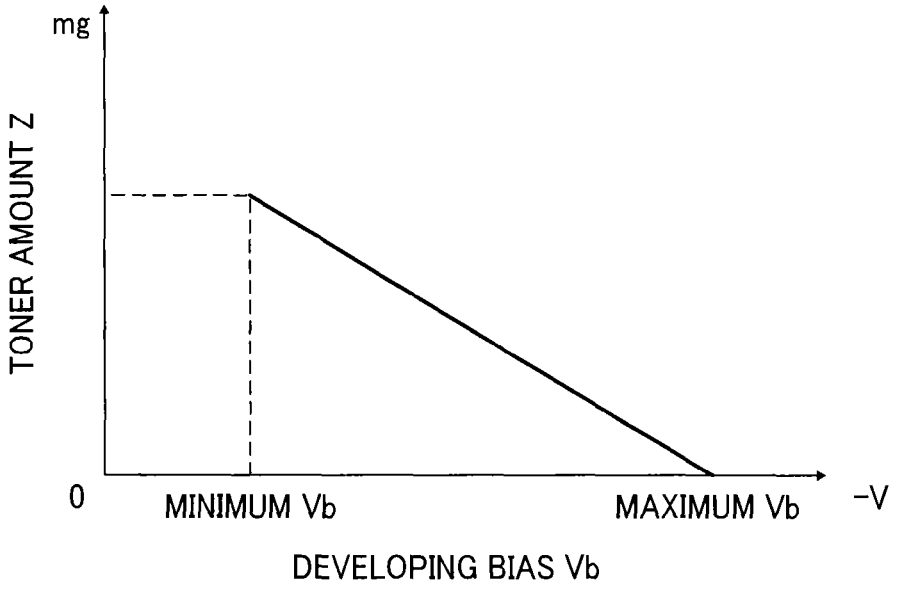
FIG. 6 is a graph of a relation between a developing bias determined by the image density adjustment control and an amount of toner to forcibly consume.

According to this embodiment, a smaller amount of toner is forcibly consumed in response to a higher developing bias Vb as adjusted by the image density adjustment control. In other words, the amount of toner to forcibly consume is determined according to the developing bias Vb. The relation between the developing bias Vb and the amount of toner to forcibly consume can be obtained by, e.g., experiments beforehand, and results can be shown in a graph as illustrated in FIG. 6. Relation data that shows the relation between the developing bias Vb and the amount of toner to forcibly consume is stored in, e.g., the RAM 21 of the controller 30 in advance. The CPU 19 executes a forced toner consumption program to calculate an amount Zn of toner to be forcibly consumed (hereinafter simply referred to as a toner amount Zn) corresponding to the developing bias Vb as adjusted by the image density adjustment control by using the relation data stored in, e.g., the RAM 21 (S15).

According to this embodiment, the permeability sensor 5*e* detects a toner density T (S16). If the toner density T thus detected is not lower than a predetermined level $T_{th}$ (Yes in S17), then the forced toner consumption is performed with the toner amount Zn calculated in step S15 (S18). The toner density of the developer contained in the developing devices 5 is sufficiently high when the toner density T is not lower than the predetermined level $T_{th}$. Therefore, the forced toner consumption is performed with the toner amount Zn calculated according to the developing bias Vb, without excessively decreasing the toner density in the developing devices 5. Accordingly, a desired image density can be obtained.

On the other hand, if the toner density T thus detected is lower than the predetermined level $T_{th}$ (No in S17), then the toner amount Zn thus calculated in S15 and a predetermined maximum allowed toner amount Zc are compared (S19). If the toner amount Zn is smaller than the maximum allowed toner amount Zc (No in S19), the forced toner consumption is performed with the toner amount Zn (S18). If the toner amount Zn is not smaller than the maximum allowed toner amount Zc (Yes in S19), the forced toner consumption is performed with the maximum allowed toner amount Zc (S20). With the maximum allowed toner amount Zc, the forced toner consumption can be performed to obtain a desired image density when the toner density T is lower than the predetermined level $T_{th}$. In other words, the forced toner consumption can be performed to obtain a desired image density with an amount not greater than the maximum allowed toner amount Zc when the toner density T is lower than the predetermined level $T_{th}$.

It is to be noted that the maximum allowed toner amount Zc can be any amount predetermined by, e.g., experiments. Note, however, that if the maximum allowed toner amount Zc is 0, forced toner consumption is not performed.

Figure 7:
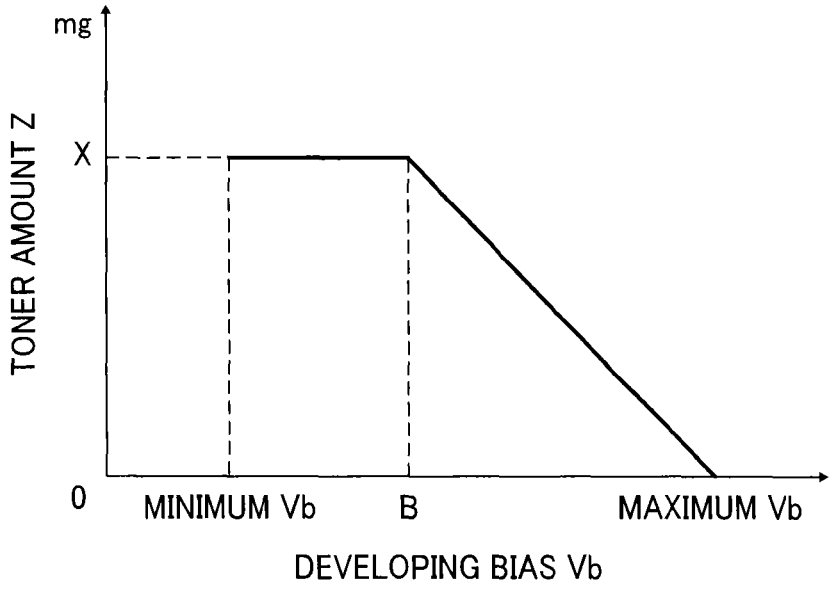
FIG. 7 is a graph of another relation between a developing bias determined by the image density adjustment control and an amount of toner to forcibly consume.

According to this embodiment, the toner consumption may be performed with the toner amount Zn greater than the maximum allowed toner amount Zc when the toner density T is not lower than the predetermined level $T_{th}$. In such a case, an upper limit of the toner amount Zn may be determined to prevent excessive decrease in the toner density T, by using, e.g., relation data illustrated in FIG. 7 instead of using the relation data illustrated in FIG. 6. The upper limit of the toner amount Zn does not exceed a level indicated by X in FIG. 7.

After the forced toner consumption is performed as described above, the image density adjustment control is executed again (S21). This is because the optimum developing potential conditions are changed by the forced toner consumption, which changes the density and charged amount of toner in the developing devices 5 from the time when the image density adjustment control is executed before the forced toner consumption control.

Figure 8:
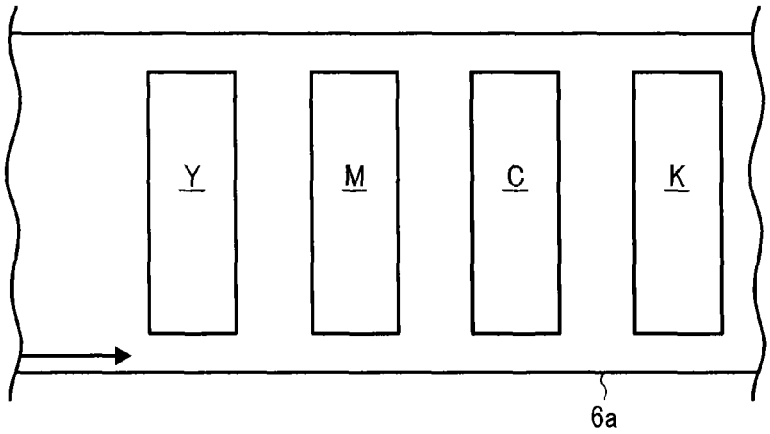
FIG. 8 is a plan view of an intermediate transfer belt on which toner patterns are formed.
Figure 9:
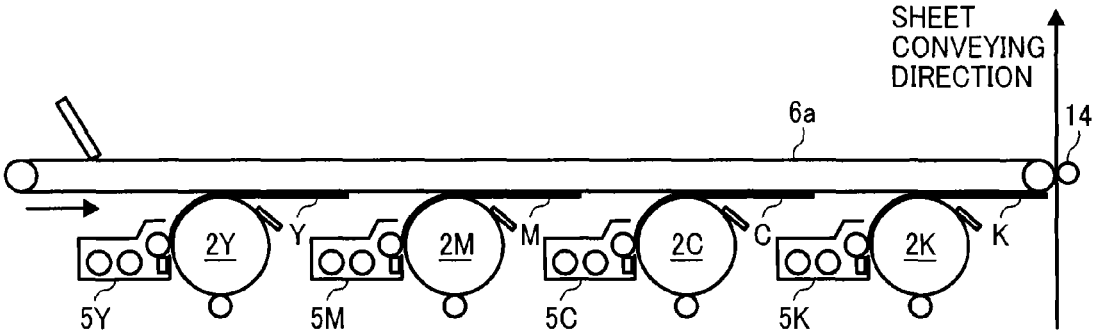
FIG. 9 is a schematic view of the intermediate transfer belt and associated components, illustrating the timing of forming the toner patterns on the intermediate transfer belt.

Referring now to FIGS. 8 and 9, a description is given of toner patterns to forcibly consume the toner.

FIG. 8 is a plan view of the intermediate transfer belt 6*a* on which the toner patterns of yellow (Y), magenta (M), cyan (C), and black (K) are formed. FIG. 9 is a schematic view of the intermediate transfer belt 6*a* and associated components, namely, the photoconductors 2, the developing devices 5, and the secondary transfer roller 14, illustrating the timing of forming the respective toner patterns on the intermediate transfer belt 6*a*.

To forcibly consume toner, firstly, electrostatic latent image patterns are formed on the photoconductors 2. The electrostatic latent image patterns thus formed are developed by the developing devices 5 with toner. Specifically, the toner is attached to the electrostatic latent image patterns, and thus, visible toner patterns are formed on the photoconductors 2. According to this embodiment, the toner patterns are transferred onto the intermediate transfer belt 6*a* and collected by the belt cleaner 6*h*. Alternatively, the toner patterns may be collected by the cleaning devices 3, without being transferred onto the intermediate transfer belt 6*a*.

The amount of toner to be forcibly consumed can be adjusted according to the area and type of the electrostatic latent image patterns formed on the photoconductors 2. The electrostatic latent image patterns may be formed for solid image or halftone image. The amount of toner to be forcibly consumed can be adjusted by changing the length of such images in a sub-scanning direction. A relatively large amount of toner is consumed when an electrostatic latent image pattern for solid image is formed across an entire imaging area on each of the photoconductors 2. In such a case, the toner is frequently replaced while cleaning may be insufficient. By contrast, cleaning is sufficient when an electrostatic latent image pattern for halftone image is formed. However, it takes a longer period of time to form the electrostatic latent image pattern for halftone image in a scanning direction than the electrostatic latent image pattern for solid image.

According to this embodiment, the toner patterns formed by the forced toner consumption are transferred onto the intermediate transfer belt 6*a* and collected by the belt cleaner 6*h*. Alternatively, some toner of the toner patterns may be transferred onto the intermediate transfer belt 6*a* and collected by the belt cleaner 6*h*, while the residual toner may be collected by the cleaning device 3 from the photoconductors 2. An amount of the residual toner on the photoconductors 2 is determined by, e.g., adjustment of the primary transfer bias applied to the primary transfer rollers 7.

As illustrated in FIG. 8, the toner patterns are formed on the intermediate transfer belt 6*a* at a predetermined interval so that the toner patterns are not continuous. Accordingly, the belt cleaner 6*h* does not receive an excessive amount of toner at once, thereby preventing insufficient cleaning. If the toner amount Zn or the maximum allowed toner amount Zc cannot be forcibly consumed at once, a process of the forced toner consumption is repeated to consume the toner amount Zn or the maximum allowed toner amount Zc.

As illustrated in FIG. 9, the electrostatic latent image patterns are simultaneously formed on the respective photoconductors 2. Accordingly, the process of forced toner consumption is performed in a relatively short period of time. The electrostatic latent image patterns are formed on the photoconductors 2 with a length in the sub-scanning direction that prevents the toner patterns from contacting each other when the toner patterns are transferred onto the intermediate transfer belt 6*a*, according to the distance between the adjacent primary transfer areas in which the electrostatic latent image patterns are transferred onto the intermediate transfer belt 6*a*. For example, if the adjacent primary transfer areas are positioned at a distance of about 11 cm, each of the toner patterns has at most a length of about 10.5 cm in the sub-scanning direction.

A description is now given of an experiment to confirm effects of the forced toner consumption.

Figure 10:
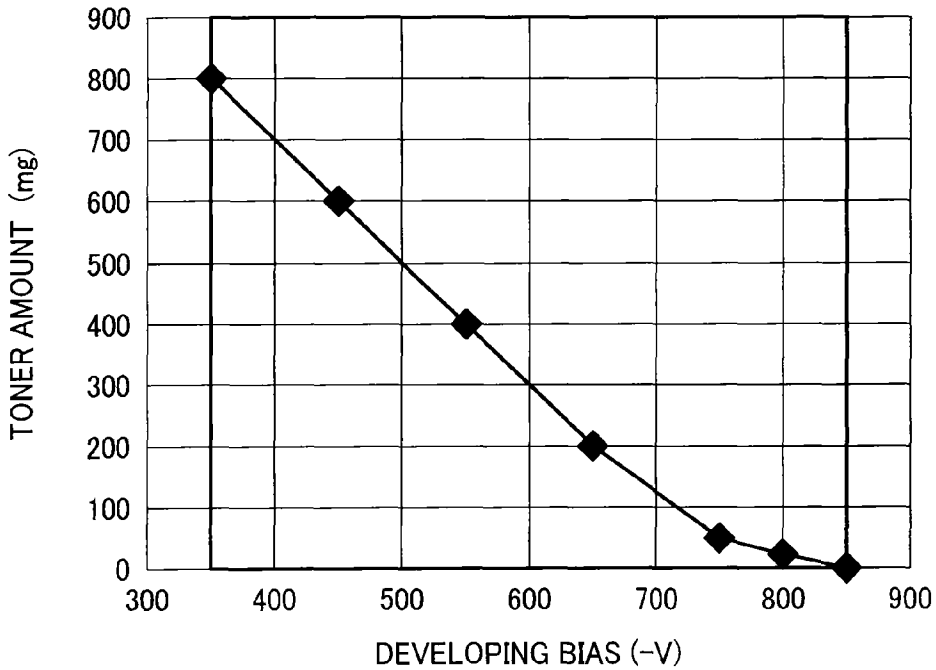
FIG. 10 is a graph of a relation between a developing bias and an amount of toner to forcibly consume with a table thereof.

FIG. 10 is a graph of a relation between a developing bias and an amount of toner to forcibly consume with a table thereof. FIG. 11 is a table of evaluation of background contamination for each example, that is, examples 1 to 4 and comparative examples 1 and 2.

In the examples 1 to 4, the forced toner consumption was performed with an amount of toner calculated according to the relation illustrated in FIG. 10 relative to absolute developing bias determined by the image density adjustment control. In the comparative examples 1 and 2, the forced toner consumption was performed with a smaller amount of toner than the amount of toner calculated according to the relation illustrated in FIG. 10. Evaluation A indicates the level of background contamination after the forced toner consumption was performed. Evaluation B indicates the level of background contamination before the forced toner consumption was performed. There are four levels of background contamination in FIG. 4. Level 1 indicates no background contamination on a sheet. Level 2 is visible but not especially noticeable background contamination on a sheet. Level 3 indicates visible, not especially noticeable background contamination on a sheet but noticeable compared to Level 2 contamination. Level 4 indicates noticeable background contamination on a sheet.

In the experiment, a developing device contained a developer having a toner density of 7% and a weight of 200 g including carrier of 186 g. Each of the toner patterns formed by the forced toner consumption had a constant length of 28 cm in the main-scanning direction and at most a length of 10.5 cm in the sub-scanning direction. Each of the toner patterns included toner of 0.5 mg/cm$^2$. The forced toner consumption was performed so that the toner patterns did not contact each other when transferred onto the intermediate transfer belt 6*a*. When the amount of toner over 147 mg (=28 cm×10.5 cm×0.5 mg/cm$^2$) was to be forcibly consumed, the process of the forced toner consumption was repeated to completely consume the amount of toner.

In the examples 1 to 4 illustrated in FIG. 11, the forced toner consumption was performed with the amount of toner calculated according to the developing bias. As a result, background contamination was minimized sufficiently. Specifically, background contamination was visible, regardless whether it was noticeable or not, before the forced toner consumption was performed. After the forced toner consumption was performed with the amount of toner calculated according to the developing bias, there was no background contamination. By contrast, in the comparative examples 1 and 2, the forced toner consumption was performed with a smaller amount of toner than the amount of toner calculated according to the developing bias. As a result, the level of background contamination was decreased. However, a sufficient improvement was not achieved. Specifically, background contamination was visible, regardless whether it was noticeable or not, before the forced toner consumption was performed. After the forced toner consumption was performed with a smaller amount of toner than the amount of toner calculated according to the developing bias, background contamination was not especially noticeable, but still visible.

Referring now to FIGS. 12 to 16, a description is given of a first variation of the forced toner consumption control described above.

Figure 12:
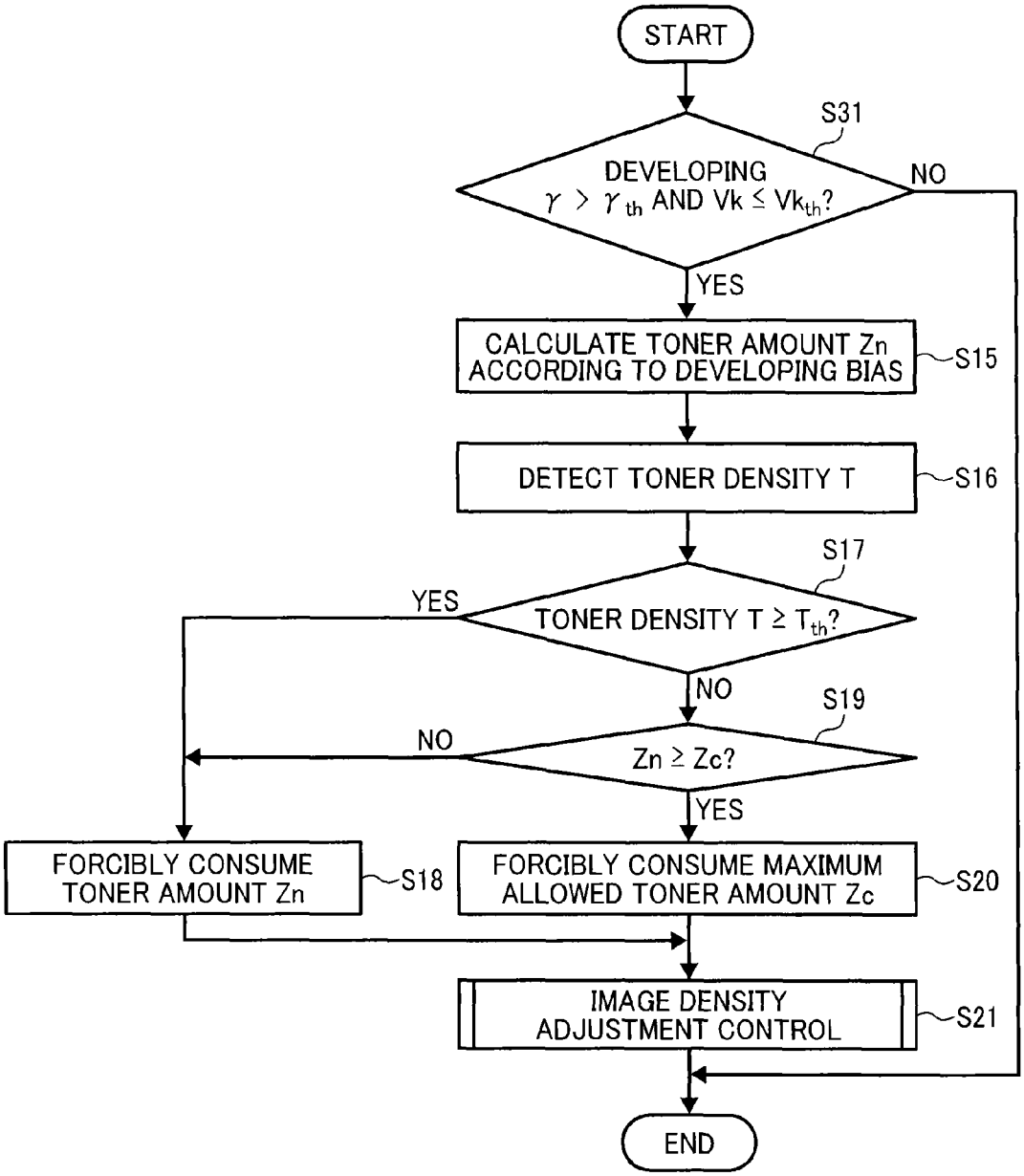
FIG. 12 is a flowchart of a forced toner consumption control process as a first variation of the forced toner consumption control of FIG. 5.

FIG. 12 is a flowchart of a process of the forced toner consumption control as the first variation.

According to the forced toner consumption control described above, it is determined whether the forced toner consumption is performed, according to the relation between the current absolute humidity $A_n$ and the uncontrolled period of time (S11 to S14). According to the forced toner consumption control as the first variation, it is determined whether the forced toner consumption is performed according to the developing γ calculated upon the image density adjustment control. The developing γ is obtained by a formula of Vt/Vk, where Vt represents an amount of adhering toner, which corresponds to the image density of each toner patch, when the developing potential is 0 and Vk represents a developing potential when the amount of adhering toner is 0.

FIGS. 13 to 16 illustrates examples of the relation between the amount of adhering toner and the developing potential. As in the two-dimensional coordinate system of FIG. 4, each of FIGS. 13 to 16 illustrates a straight line, which indicates linear approximation of a relational function of the relation between the amount of adhering toner (mg/cm$^2$) and the developing potential (kV). The vertical axis indicates the amount of adhering toner, and the horizontal axis indicates the developing potential. Vt represents an intercept of the straight line with the vertical axis, and Vk represents an intercept of the straight line with the horizontal axis. The developing γ is the gradient of the straight line.

A greater developing γ causes a higher developing capability. With a higher developing capability, background contamination is likely to occur. By contrast, a smaller developing γ causes a lower developing capability. With a lower developing capability, background contamination is unlikely to occur. Vk is also a background potential that causes background contamination. When Vk is greater than 0, background contamination is unlikely to occur regardless of the developing γ.

Accordingly, in the first variation of the forced toner consumption control, the forced toner consumption is performed (S15 to S21) when a first condition is satisfied (Yes in S31), in which the developing γ is greater than a reference level $\gamma_{th}$ and Vk is not greater than a reference level $Vk_{th}$ that is not greater than 0. By contrast, the forced toner consumption is not performed when a second or third condition is satisfied (No in S31). The second condition is that the developing γ is not greater than the reference level $\gamma_{th}$ and Vk is not greater than the reference level $Vk_{th}$. The third condition is that Vk is greater than the reference level $Vk_{th}$. The first, second, and third conditions are illustrated in FIGS. 13 to 16.

Figure 13:
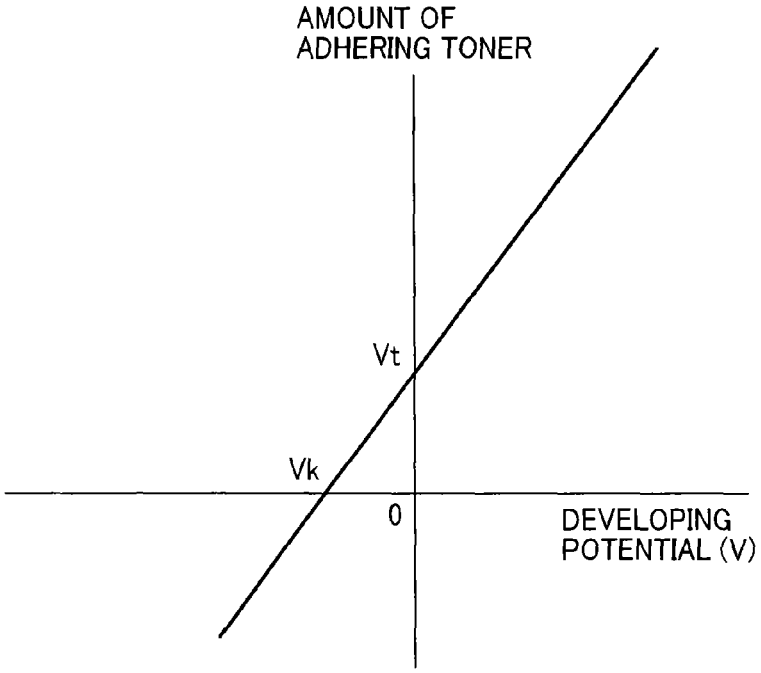
FIG. 13 is a graph of an amount of adhering toner and a developing potential when a first condition is satisfied.
Figure 14:
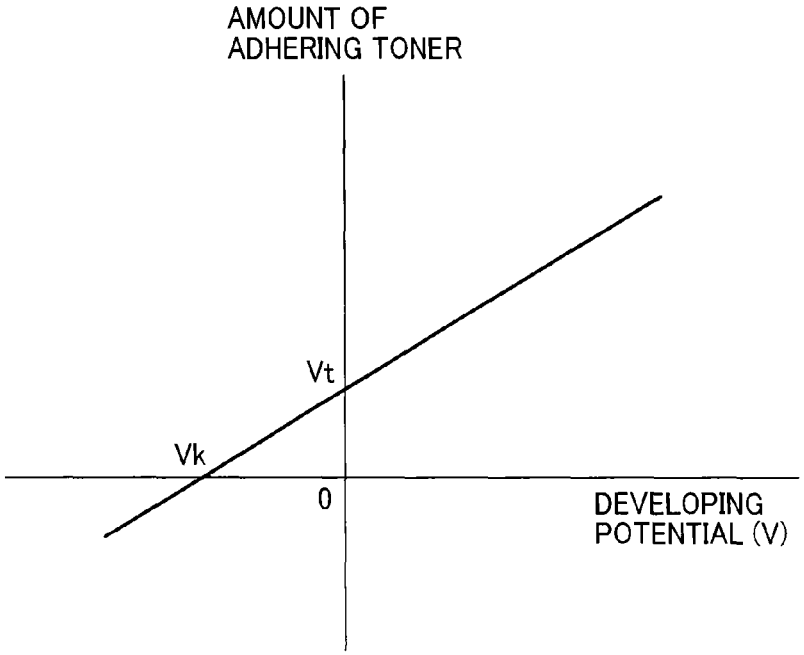
FIG. 14 is a graph of an amount of adhering toner and a developing potential when a second condition is satisfied.
Figure 15:
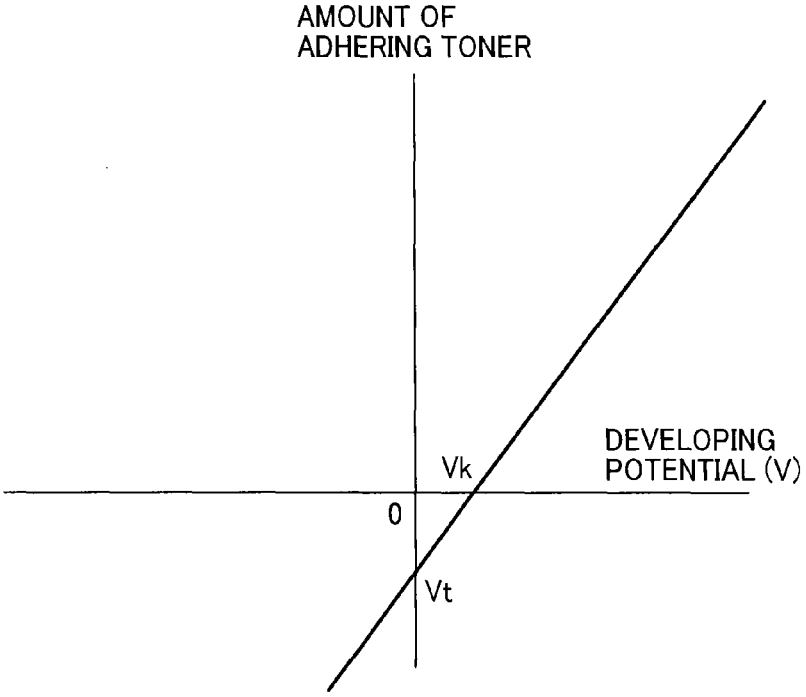
FIG. 15 is a graph of an amount of adhering toner and a developing potential when a third condition is satisfied.
Figure 16:
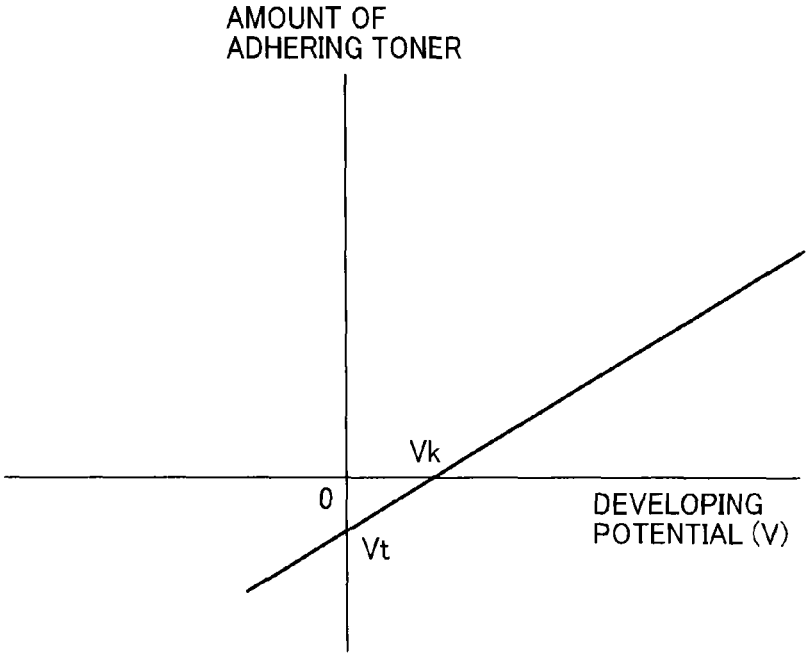
FIG. 16 is another graph of an amount of adhering toner and a developing potential when the third condition is satisfied.

FIG. 13 is a graph of a relation between the amount of adhering toner and the developing potential when the first condition is satisfied. FIG. 14 is a graph of a relation between the amount of adhering toner and the developing potential when the second condition is satisfied. FIG. 15 is a graph of a relation between the amount of adhering toner and the developing potential when the third condition is satisfied. FIG. 16 is a graph of another relation between the amount of adhering toner and the developing potential when the third condition is satisfied.

According to the first variation of the forced toner consumption control, the forced toner consumption is performed when the first condition is satisfied, that is, when the relation between the amount of adhering toner and the developing potential is as illustrated in FIG. 13. By contrast, the forced toner consumption is not performed when the second or third condition is satisfied, that is, the relation between the amount of adhering toner and the developing potential is as illustrated in FIGS. 14 to 16.

The reference level $\gamma_{th}$ is herein 0, but is not limited thereto. The reference level $\gamma_{th}$ can be any level determined by, e.g., experiments. Similarly, the reference level $Vk_{th}$ can be any level determined by, e.g., experiments.

In addition, according to the first variation of the forced toner consumption control, the forced toner consumption is not performed when the second or third condition is satisfied. Alternatively, the forced toner consumption may be performed when the second or third condition is satisfied as illustrated in FIGS. 14 to 16 with a smaller amount of toner than the amount of toner forcibly consumed when the first condition is satisfied as illustrated in FIG. 13.

Figure 17:
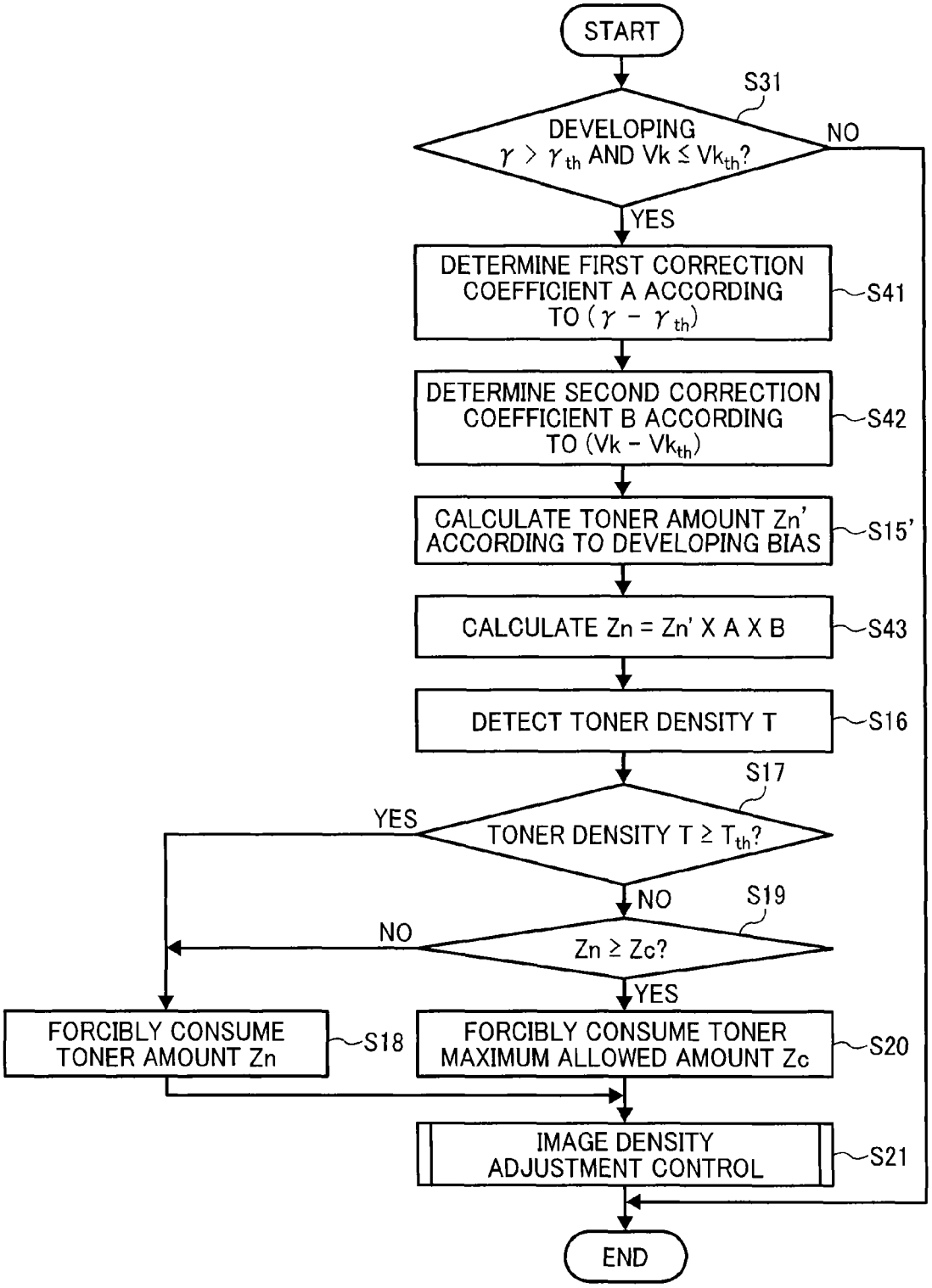
FIG. 17 is a flowchart of a forced toner consumption control process as a second variation of the forced toner consumption control of FIG. 5.

Referring now to FIGS. 17 and 18, a description is given of a second variation of the forced toner consumption control described above.

FIG. 17 is a flowchart of a process of the forced toner consumption control as the second variation.

Similarly to the forced toner consumption control as the first variation, the forced toner consumption as the second variation is performed when the first condition is satisfied (Yes in S31), in which the developing γ is greater than the reference level $\gamma_{th}$ and Vk is not greater than the reference level $Vk_{th}$ that is not greater than 0. However, the toner amount Zn is determined in a different way from the forced toner consumption as the first variation.

Specifically, an amount Zn' of toner to be forcibly consumed (hereinafter simply referred to as a toner amount Zn') is corrected according to a first correction coefficient A so that a greater difference between the developing γ and the reference level $\gamma_{th}$ results in a greater toner amount Zn after correction. It is to be noted that the toner amount Zn' is calculated according to the developing bias before correction. The first correction coefficient A is determined by using, e.g., a table of FIG. 18 (S41).

FIG. 18 is a table of a relation between the difference between the developing γ and the reference level $\gamma_{th}$, and the first correction coefficient A.

If the difference between the developing γ and the reference level $\gamma_{th}$ is less than 0.1, then a first correction coefficient A1 is determined. If the difference between the developing γ and the reference level $\gamma_{th}$ is not less than 0.1 and less than 0.2, then a first correction coefficient A2 is determined. If the difference between the developing γ and the reference level $\gamma_{th}$ is not less than 0.2, then a first correction coefficient A3 is determined. The first coefficients A1, A2, and A3 are determined to satisfy a relation of A1<A2<A3.

In addition, the amount Zn' is corrected according to a second correction coefficient B so that a greater difference between Vk and the reference level $Vk_{th}$ results in a greater toner amount Zn after correction. The second correction coefficient B is determined by using, e.g., a table of FIG. 19 (S42).

FIG. 19 is a table of a relation between the difference between Vk and the reference level $Vk_{th}$, and the second correction coefficient B. If the difference between Vk and the reference level $Vk_{th}$ is less than 30 V, then a second correction coefficient B1 is determined. If the difference between Vk and the reference level $Vk_{th}$ is not less than 30 V and less than 60V, then a second correction coefficient B2 is determined. If the difference between Vk and the reference level $Vk_{th}$ is not less than 60 V and less than 90 V, then a second correction coefficient B3 is determined. If the difference between Vk and the reference level $Vk_{th}$ is not less than 90 V, then a second correction coefficient B4 is determined. The second coefficients B1, B2, B3, and B4 are determined to satisfy a relation of B1<B2<B3<B4.

After the first correction coefficient A and the second correction coefficient B are determined, the toner amount Zn' is calculated according to the developing bias Vb as described above (S15'). Then, a formula of Zn=Zn'×A×B is calculated to correct the toner amount Zn' (S43). By using the first correction coefficient A and the second correction coefficient B, the toner amount Zn is calculated based on the difference between the developing γ the reference level $\gamma_{th}$, and the difference between Vk and the reference level $Vk_{th}$.

Figure 20:
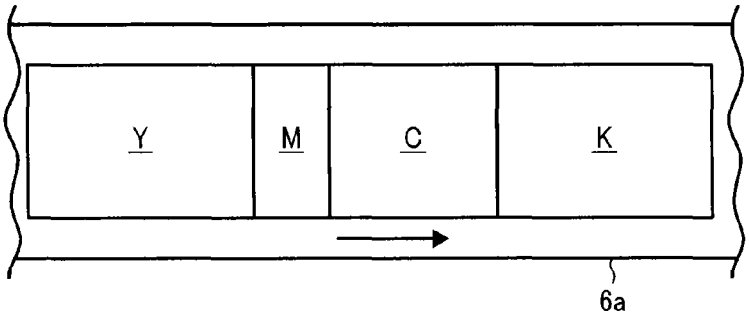
FIG. 20 is a plan view of the intermediate transfer belt on which toner patterns are formed according to the forced toner consumption control as a third variation.
Figure 21:
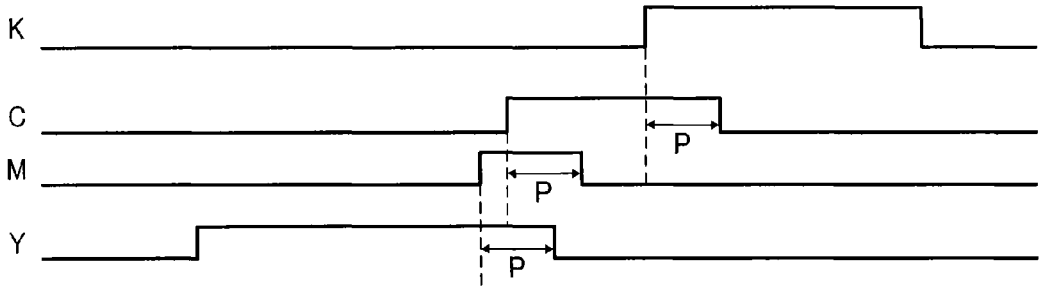
FIG. 21 is a timing chart of forming electrostatic latent image patterns according to the forced toner consumption control as the third variation.

Referring now to FIGS. 20 and 21, a description is given of a forced toner consumption control as a third variation of the forced toner consumption control described above.

FIG. 20 is a plan view of the intermediate transfer belt 6*a* on which the toner patterns are formed according to the forced toner consumption control as the third variation.

To shorten the time to complete the forced toner consumption control, the forced toner consumption control as the third variation is executed in which the respective toner patterns formed on the photoconductors 2 are transferred onto the intermediate transfer belt 6*a* to be a continuous toner pattern thereon. Specifically, as illustrated in FIG. 20, a toner pattern of a color is transferred from the surface of the photoconductor 2 onto the intermediate transfer belt 6*a* with its trailing end continuous with a leading end of a toner pattern of another color that is transferred previously onto the intermediate transfer belt 6*a*. Thus, the continuous toner pattern constructed of the toner patterns of yellow (Y), magenta (M), cyan (C), and black (K) is formed on the intermediate transfer belt 6*a*. More specifically, the amount of toner to forcibly consume by the forced toner consumption control differs among the developing devices 5. Accordingly, the toner patterns formed by the forced toner consumption usually have different lengths in the sub-scanning direction. According to the forced toner consumption control as the third variation, the continuous toner pattern is formed on the intermediate transfer belt 6*a*, as illustrated in FIG. 20, even when the toner patterns constructing the continuous toner pattern have different lengths in the sub-scanning direction.

FIG. 21 is a timing chart of forming electrostatic latent image patterns according to the forced toner consumption control as the third variation.

The photoconductors 2 of four colors, in this case of yellow, magenta, cyan and black, are disposed side by side in this order from upstream to downstream in a direction in which the intermediate transfer belt 6*a* rotates. It is to be noted that the colors of yellow, magenta, cyan and black are herein called a first color (Y), a second color (M), a third color (C), and a fourth color (K), respectively. The forced toner consumption is executed starting with the first color (Y), and then the second color (M), the third color (C), and ending with the fourth color (K). As illustrated in FIG. 21, formation of an electrostatic latent image pattern of the second color (M) on the photoconductor 2M starts earlier than the time when formation of an electrostatic latent image pattern of the first color (Y) on the photoconductor 2Y is completed by a time P. The time P is obtained by a formula of P=L/V, where L is a distance of the intermediate transfer belt 6*a* between the primary transfer area of the first color (Y) and the primary transfer area of the second color (M), and V is a speed at which the intermediate transfer belt 6*a* rotates. An electrostatic latent image pattern of the third color (C) and an electrostatic latent image pattern of the fourth color (K) are similarly formed on the photoconductors 2C and 2K, respectively. Thus, formation of an electrostatic latent image pattern of the nth color starts earlier than the time when formation of an electrostatic latent image pattern of the n−1 th color is completed by the time P.

The forced toner consumption control as the third variation is executed in a minimum period of time in which the continuous toner pattern is formed on the intermediate transfer belt 6*a* without superimposing the toner patterns constructing the continuous toner pattern one atop another.

It is to be noted that the forced toner consumption may be performed simply by applying the developing bias to move the toner to the photoconductors 2, instead of forming the electrostatic latent image patterns on the photoconductors 2. However, in such a case, rise and fall of the developing voltage may disturb accurate control of the respective front and trailing end positions of the toner patterns. Forced toner consumption such as the forced toner consumption as the third variation involves accurate control of the respective front and trailing end positions of toner patterns constructing a continuous pattern formed on the intermediate transfer belt 6*a*, because the continuous toner pattern is formed without superimposing the toner patterns one atop another. Accordingly, the toner patterns are preferably formed in a manner similar to a typical toner image formed through the charging, exposure, and developing processes.

The above-description is given of an embodiment of this disclosure. This disclosure provides effects specific to the individual aspects described below.

According to a first aspect of this disclosure, there is provided an image forming apparatus (e.g., image forming apparatus 100), which includes a latent image carrier (e.g., photoconductor 2), a developing device (e.g., developing device 5), a transfer unit (e.g., intermediate transfer unit 6), and a controller (e.g., controller 30). The latent image carrier carries a latent image on a surface thereof. The developing device contains a two-component developer including toner and carrier charged to a predetermined polarity, to electrostatically attach the toner to the latent image with a developing bias (e.g., developing bias Vb) to form a toner image on the surface of the latent image carrier. The transfer unit transfers the toner image from the surface of the latent image carrier finally onto a recording medium. The controller executes an image density adjustment control of adjusting the developing bias to obtain a target image density at a predetermined time (e.g., when the power is turned on). The controller further executes a forced toner consumption control of forcibly consuming the toner contained in the developing device at a predetermined time (e.g., immediately after the image density adjustment control) by attaching the toner to the latent image carrier to form a toner pattern on the surface of the latent image carrier. The controller executes the forced toner consumption control to forcibly consume a smaller amount of toner in response to a higher developing bias as adjusted by the image density adjustment control.

Background contamination is likely to occur when the toner density is relatively high and the toner is insufficiently charged in the developing device. When the toner density is relatively high and the toner is insufficiently charged in the developing device, the toner density does not excessively decrease even if the insufficiently charged toner is discharged from the developing device by the forced toner consumption control to facilitate the frictional charging of toner and recover the charge on the toner in the developing device. Accordingly, a desired image density can be obtained. In other words, the forced toner consumption control is executed without excessively decreasing the toner density in the developing device, by discharging a relatively large amount of toner from the developing device when the toner density is relatively high and the toner is insufficiently charged in the developing device. Accordingly, background contamination is prevented and a desired image density is obtained. By contrast, background contamination is unlikely to occur when the toner density is relatively low and the toner is sufficiently charged in the developing device. In such a case, the forced toner consumption control is executed without excessively decreasing the toner density in the developing device, by discharging a smaller amount of toner from the developing device than an amount of toner when the toner density is relatively high and the toner is insufficiently charged in the developing device. Accordingly, background contamination is prevented and a desired image density is obtained.

Generally, in the image density adjustment control of adjusting the developing bias to obtain a target image density, the developing bias is adjusted to be relatively low when the toner density is relatively low and the toner is sufficiently charged. By contrast, the developing bias is adjusted to be relatively high when the toner density is relatively high and the toner is insufficiently charged. Accordingly, the developing bias as adjusted by the image density adjustment control is used as an index that indicates whether the toner density is relatively low and the toner is sufficiently charged, which may not cause background contamination, or the toner density is relatively high and the toner is insufficiently charged, which may cause background contamination.

Hence, in the first aspect of this disclosure, the forced toner consumption control is executed to forcibly consume a smaller amount of toner in response to a higher absolute developing bias as adjusted by the image density adjustment control. By such a forced toner consumption control, a smaller amount of toner is forcibly consumed when the toner density is relatively low and the toner is sufficiently charged, than the amount of toner when the toner density is relatively high and the toner is insufficiently charged. The smaller amount of toner to forcibly consume includes the amount of toner of 0, with which the forced toner consumption control is not executed. Accordingly, the forced toner consumption control is executed without excessively decreasing the toner density in the developing device, and therefore, background contamination is prevented and a desired image density is obtained.

According to a second aspect of this disclosure, if the controller executes the forced toner consumption control, after the image density adjustment control and before a subsequent image forming process, to forcibly consume a smaller amount of toner in response to a higher developing bias as adjusted by the image density adjustment control, the controller executes the image density adjustment control again after the forced toner consumption control and before the subsequent image forming process.

The forced toner consumption control decreases the toner density in the developing device from the time of the image density adjustment control previously performed, thereby changing the optimum developing bias to obtain a target image density. According to the second aspect of this disclosure, the image density adjustment control is executed again after the forced toner consumption control to use the latest optimum developing bias for the subsequent image forming process. Accordingly, the target image density can be obtained after the forced toner consumption control.

According to a third aspect of this disclosure, the image forming apparatus further includes a charging device (e.g., charging device 4). The charging device includes a charging member (e.g., charging roller 4*a*) disposed close to or in contact with the surface of the latent image carrier. The charging device charges the surface of the latent image carrier by applying a direct-current voltage to the charging member so that the surface of the latent image carrier acquires a target charging potential before the latent image is formed on the surface of the latent image carrier.

Some electrophotographic imaging systems employ a charging method using a contact or closely-contact DC charging method as described above. The contact or closely-contact DC charging method has a simple configuration, resulting in low production costs, compared to other charging methods, such as a charging method using a scorotron charger and a charging method using a contact or non-contact charging roller applied with alternating-current charging bias. However, in such a DC charging method, a rough surface of the charging member such as a charging roller may generate an unevenly charged surface of the photoconductor, and therefore, the potential is unevenly generated on the surface of the photoconductor. As a result, the toner may adhere to an unexposed portion of the surface of the photoconductor, herein called a background, where a latent image is not formed. Thus, the background is contaminated. A greater background potential is effective to prevent such background contamination. The background potential is the difference between the potential of the portion where a latent image is not formed (i.e., the background) and the potential of a developing roller. However, when the two-component developer including toner and carrier is used, a greater background potential may cause the carrier to electrostatically adhere to the background. Therefore, the background potential is determined in a limited range where the carrier does not adhere to the background. Accordingly, in an image forming apparatus employing the contact or closely-contact charging method and the two-component developer, such as the image forming apparatus 100, background contamination is prevented preferably by a way other than adjustment of the background potential. In the image forming apparatus according to the embodiment described above, background contamination is effectively prevented by the forced toner consumption, instead of adjustment of the background potential.

According to a fourth aspect of this disclosure, the controller detects absolute humidity according to detection data from, e.g., a temperature sensor (e.g., temperature sensor 22) and a humidity sensor (e.g., humidity sensor 23). If the controller executes the image density adjustment control at the predetermined time when a detected absolute humidity is 15 $g/m^3$ or greater, when an absolute humidity detected in a previous image density adjustment control is 15 $g/m^3$ or greater, and after a predetermined time elapses during which an image forming process is not performed, the controller executes the forced toner consumption control to forcibly consume a smaller amount of toner in response to a higher developing bias as adjusted by the image density adjustment control.

Accordingly, in a high-temperature, high-humidity environment that may cause background contamination because of insufficiently charged toner regardless of deterioration of the toner, the forced toner consumption control is executed without excessively decreasing the toner density in the developing device. Accordingly, background contamination is prevented and a desired image density is obtained.

According to a fifth aspect of this disclosure, the controller detects absolute humidity. If the controller executes the image density adjustment control at the predetermined time when a detected absolute humidity is 15 g/m$^3$ or greater and when an absolute humidity in the previous image density adjustment control is less than 15 g/m$^3$, the controller executes the forced toner consumption control to forcibly consume a smaller amount of toner in response to a higher developing bias as adjusted by the image density adjustment control.

Accordingly, in the high-temperature, high-humidity environment that may cause background contamination because of insufficiently charged toner regardless of deterioration of the toner, the forced toner consumption control is executed without excessively decreasing the toner density in the developing device. Accordingly, background contamination is prevented and a desired image density is obtained.

According to a sixth aspect of this disclosure, the image forming apparatus further includes a toner density detector (e.g., permeability sensor 5*e*) to detect toner density (e.g., toner density T) of the two-component developer in the developing device. If the toner density detector detects a toner density lower than a predetermined level (predetermined level $T_{th}$), the controller executes the forced toner consumption control to forcibly consume a smaller amount of toner than an amount of toner when a detected toner density is not lower than the predetermined level.

Accordingly, the forced toner consumption is stably performed with a smaller amount of toner when the detected toner density is lower than the predetermined level $T_{th}$, that is, the toner density is relatively low. As a result, a desired image density can be obtained.

According to a seventh aspect of this disclosure, the image forming apparatus further includes a toner amount detector (e.g., optical sensor 17). The controller forms a gradation pattern on the surface of the latent image carrier. The gradation pattern is constructed of a plurality of toner patches having different amounts of toner. The controller detects the different amounts of toner of the plurality of toner patches via the toner amount detector. The controller executes the image density adjustment control according to detected amounts of toner of the plurality of toner patches. The controller executes the forced toner consumption control to forcibly consume a larger amount of toner when a first condition is satisfied than an amount of toner when a second or third condition is satisfied. It is to be noted that a relation between the developing potential and an amount of toner derived from the detected amounts of toner of the plurality of toner patches is indicated by a straight line in a two-dimensional coordinate system. The vertical axis indicates the amount of toner while a horizontal axis indicates the developing potential. Vt indicates an intercept of the straight line with the vertical axis while Vk indicates an intercept of the straight line with the horizontal axis. The first condition is that a gradient of the straight line, that is, a developing γ, is greater than a reference gradient level (e.g., reference level $\gamma_{th}$) and Vk is not greater than a reference level of Vk (e.g., reference level $Vk_{th}$) that is not greater than 0. The second condition is that the gradient of the straight line (developing γ) is not greater than the reference gradient level and Vk is not greater than the reference level of Vk. The third condition is that Vk is greater than the reference level of Vk.

As described above with respect to the first variation of the forced toner consumption control, a greater developing γ (Vt/Vk) attains a higher developing capability. With a higher developing capability, background contamination is likely to occur. By contrast, a smaller developing γ attains a lower developing capability. With a lower developing capability, background contamination is unlikely to occur. Vk is also a point of background potential that causes background contamination. When Vk is over 0, background contamination is unlikely to occur regardless of the developing γ. According to the seventh aspect of this disclosure, the forced toner consumption control is executed to forcibly consume a larger amount of toner when the first condition is satisfied than the amount of toner when the second or third condition is satisfied. In other words, a larger amount of toner is forcibly consumed when background contamination is likely to occur than the amount of toner when background contamination is unlikely to occur. Thus, the forced toner consumption is performed with an appropriate amount of toner, without consuming an excessive amount of toner.

According to an eighth aspect of this disclosure, if the first condition is satisfied, the controller executes the forced toner consumption control to forcibly consume a larger amount of toner in response to a greater difference between the gradient of the straight line and the reference gradient level.

Accordingly, the forced toner consumption is performed with an appropriate amount of toner, without consuming an excessive amount of toner.

According to a ninth aspect of this disclosure, if the first condition is satisfied, the controller executes the forced toner consumption control to forcibly consume a larger amount of toner in response to a greater difference between Vk and the reference level of Vk.

Accordingly, the forced toner consumption is performed with an appropriate amount of toner, without consuming an excessive amount of toner.

According to a tenth aspect of this disclosure, the controller does not execute the forced toner consumption control at the predetermined time when the developing bias as adjusted by the image density adjustment control is not lower than a predetermined level.

Accordingly, the controller does not execute the forced toner consumption itself when the developing bias as adjusted by the image density adjustment control is not lower than the predetermined level, instead of executing the forced toner consumption with a smaller amount of toner than an amount of toner when the developing bias is lower than the predetermined level. Accordingly, an excessive decrease in the toner density is stably prevented in the developing device, and therefore, a desired image density can be obtained.

Figure 22:
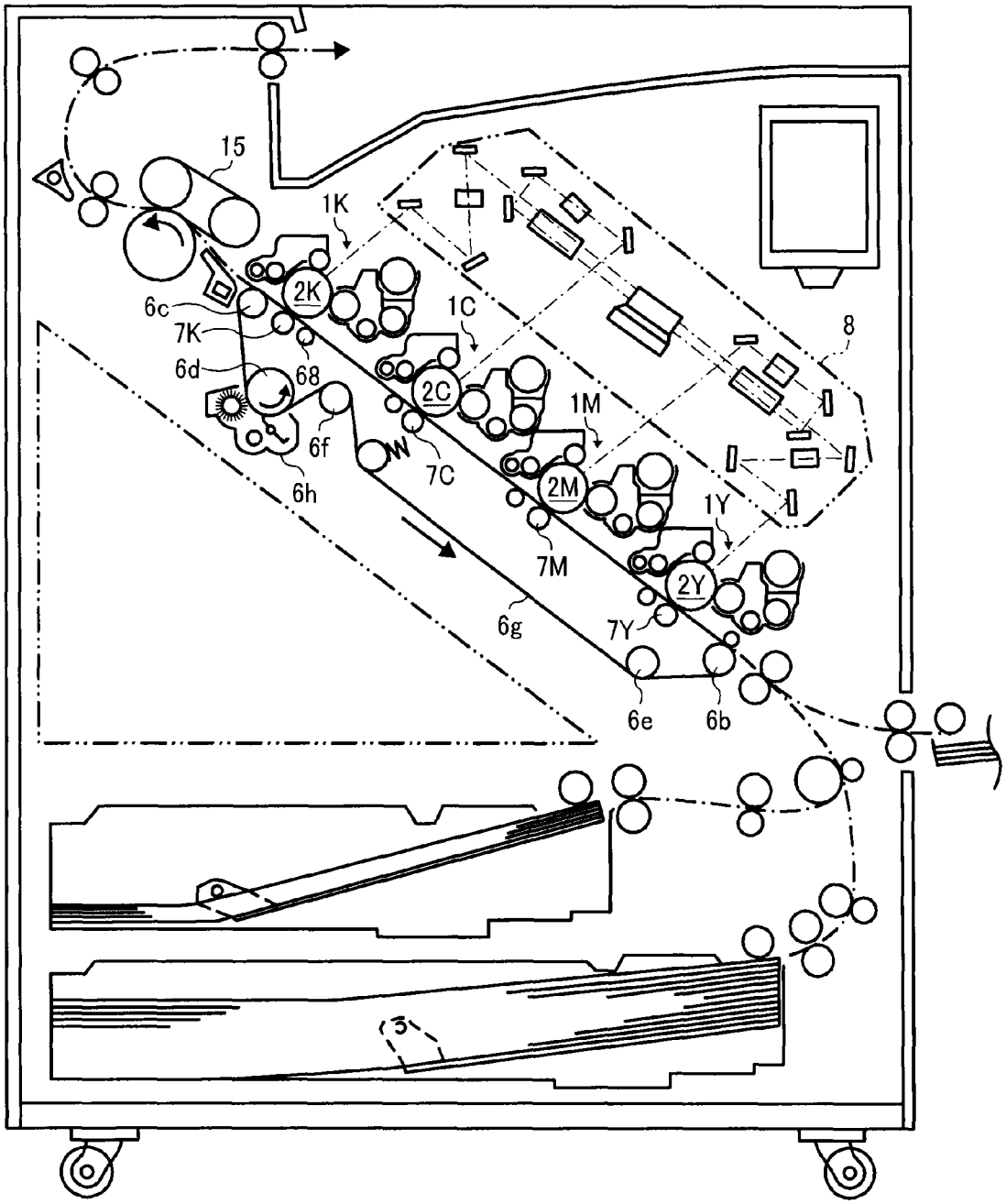
FIG. 22 is a schematic view of an image forming apparatus according to another embodiment of this disclosure.

According to an eleventh aspect of this disclosure, the image forming apparatus further includes a second latent image carrier to carry a latent image on a surface thereof, a second developing device containing a two-component developer including toner and carrier, to develop the latent image with the toner to form a toner image on the surface of the second latent image carrier, and a cleaner for an intermediate transfer body (e.g., intermediate transfer belt 6*a* illustrated in FIG. 1) or a recording medium conveyor. The recording medium conveyor carries a recording medium and is, e.g., a recording medium conveyor belt 6*g* illustrated in FIG. 22. The transfer unit includes the intermediate transfer body or the recording medium conveyor. The transfer unit transfers the toner images from the latent image carriers onto the intermediate transfer body or the recording medium carried by the recording medium conveyor while superimposing the toner images one atop another. The controller executes the forced toner consumption control of the second developing device by attaching the toner to the second latent image carrier to form a toner pattern on the surface of the second latent image carrier. The controller transfers the toner patterns from the surfaces of the latent image carriers onto the intermediate transfer body or the recording medium conveyor, via the transfer unit, without superimposing the toner patterns one atop another. The controller removes the toner patterns from the intermediate transfer body or the recording medium conveyor via the cleaner for the intermediate transfer body or the recording medium conveyor.

Accordingly, the cleaner for the intermediate transfer body or the recording medium conveyor does not receive an excessive amount of toner at once, thereby sufficiently removing the toner patterns from the intermediate transfer body or the recording medium conveyor.

According to a twelfth aspect of this disclosure, the controller simultaneously starts the forced toner consumption control of the developing devices.

Such a simple control shortens a period of time to perform the forced toner consumption.

According to a thirteenth aspect of this disclosure, the controller executes the forced toner consumption control so that the toner pattern formed on the surface of one of the latent image carriers is transferred onto the intermediate transfer body or the recording medium conveyor with a trailing end thereof continuous with a leading end of the toner pattern formed on the surface of the other latent image carrier previously transferred onto the intermediate transfer body or the recording medium conveyor.

Accordingly, the forced toner consumption is executed in a shorter period of time even when different amounts of toner are attached to the latent image carriers.

According to a fourteenth aspect of this disclosure, the image forming apparatus further includes a second latent image carrier to carry a latent image on a surface thereof, a second developing device containing a two-component developer including toner and carrier, to develop the latent image with the toner to form a toner image on the surface of the second latent image carrier, and a plurality of cleaners for the latent image carriers. The transfer unit includes an intermediate transfer body or a recording medium conveyor. The transfer unit transfers the toner images from the latent image carriers onto the intermediate transfer body or the recording medium carried by the recording medium conveyor while superimposing the toner images one atop another. The controller executes the forced toner consumption control of the second developing device by attaching the toner to the second latent image carrier to form a toner pattern on the surface of the second latent image carrier. The controller transfers some toner of the toner patterns from the surfaces of the latent image carriers onto the intermediate transfer body or the recording medium conveyor via the transfer unit. The controller removes the some toner from the intermediate transfer body or the recording medium conveyor via the cleaner for the intermediate transfer body or the recording medium conveyor, while removing residual toner from the latent image carriers via the plurality of cleaners for the latent image carriers. The controller further executes an adjustment control of adjusting a ratio of an amount of the some toner and an amount of the residual toner.

In short, the toner of the toner patterns formed on the latent image carriers by the forced toner consumption is collected separately by the cleaner for the intermediate transfer body or the recording medium conveyor and the plurality of cleaners for the latent image carriers. In addition, the controller executes the adjustment control of adjusting the ratio of the amount of the some toner, which is collected by the cleaner for the intermediate transfer body or the recording medium conveyor, and the amount of the residual toner, which is collected by the plurality of cleaners for the latent image carriers. Accordingly, insufficient cleaning is prevented.

According to a fifteenth aspect of this disclosure, the controller executes the adjustment control to adjust the ratio according to apparatus usage information.

The apparatus usage information is information of usage specific to individual image forming apparatuses. The apparatus usage information includes, e.g., the number of images formed, a total distance of rotation of a latent image carrier such as a photoconductor, an average surface area of toner images, and the environment in which the individual image forming apparatuses are used. With such change of the ratio according to the apparatus usage information, for example, a cleaner such as a cleaning blade (e.g., cleaning blade 3*b*) receives a relatively large amount of residual toner from a latent image carrier for a color merely used. In such a case, toner of a toner pattern formed on the latent image carrier by the forced toner consumption decreases the friction of the cleaner and the latent image carrier, preventing cleaning deterioration. It is to be noted that it is determined whether the latent image carrier is one for a color merely used by, e.g., a condition that the average surface area of toner images relative to the distance of rotation of the latent image carrier is not greater than a threshold.

The present invention, although it has been described above with reference to specific exemplary embodiments, is not limited to the details of the embodiments described above, and various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. An image forming apparatus comprising:

a latent image carrier to carry a latent image on a surface thereof;

a developing device containing a two-component developer including toner and carrier charged to a predetermined polarity, to electrostatically attach the toner to the latent image with a developing bias to form a toner image on the surface of the latent image carrier, a transfer unit to transfer the toner image from the surface of the latent image carrier onto a recording medium;

a controller to execute an image density adjustment control of adjusting the developing bias to obtain a target image density at a predetermined time, and further execute a forced toner consumption control of forcibly consuming the toner contained in the developing device at a predetermined time by attaching the toner to the latent image carrier to form a toner pattern on the surface of the latent image carrier, the controller executing the forced toner consumption control to forcibly consume a smaller amount of toner in response to a higher developing bias as adjusted by the image density adjustment control.

2. The image forming apparatus according to claim 1, wherein, if the controller executes the forced toner consumption control, after the image density adjustment control and before a subsequent image forming process, to forcibly consume a smaller amount of toner in response to a higher developing bias as adjusted by the image density adjustment control, the controller executes the image density adjustment control again after the forced toner consumption control and before the subsequent image forming process.

3. The image forming apparatus according to claim 1, further comprising a charging device including a charging member disposed close to or in contact with the surface of the latent image carrier, wherein the charging device charges the surface of the latent image carrier by applying a direct-current voltage to the charging member so that the surface of the latent image carrier acquires a target charging potential before the latent image is formed on the surface of the latent image carrier.

4. The image forming apparatus according to claim 1, wherein the controller detects absolute humidity, and wherein, if the controller executes the image density adjustment control at the predetermined time when a detected absolute humidity is 15 $g/m^3$ or greater, when an absolute humidity detected in a previous image density adjustment control is 15 $g/m^3$ or greater, and after a predetermined time elapses during which an image forming process is not performed, the controller executes the forced toner consumption control to forcibly consume a smaller amount of toner in response to a higher developing bias as adjusted by the image density adjustment control.

5. The image forming apparatus according to claim 1, wherein the controller detects absolute humidity, wherein, if the controller executes the image density adjustment control at the predetermined time when a detected absolute humidity is 15 $g/m^3$ or greater and when an absolute humidity detected in the previous image density adjustment control is less than 15 $g/m^3$, the controller executes the forced toner consumption control to forcibly consume a smaller amount of toner in response to a higher developing bias as adjusted by the image density adjustment control.

6. The image forming apparatus according to claim 1, further comprising a toner density detector to detect toner density of the two-component developer contained in the developing device, wherein, if the toner density detector detects a toner density lower than a predetermined level, the controller executes the forced toner consumption control to forcibly consume a smaller amount of toner than an amount of toner when a detected toner density is not lower than the predetermined level.

7. The image forming apparatus according to claim 1, further comprising a toner amount detector, wherein the controller forms a gradation pattern including a plurality of toner patches having different amounts of toner on the surface of the latent image carrier, the controller detects the different amounts of toner of the plurality of toner patches via the toner amount detector, and the controller executes the image density adjustment control according to detected amounts of toner of the plurality of toner patches, and wherein the controller executes the forced toner consumption control to forcibly consume a larger amount of toner when a first condition is satisfied than an amount of toner when a second or third condition is satisfied, wherein:

when a relation between developing potential and an amount of toner derived from the detected amounts of toner of the plurality of toner patches is indicated by a straight line in a two-dimensional coordinate system, with a vertical axis indicating the amount of toner while a horizontal axis indicating the developing potential, and with Vt indicating an intercept of the straight line with the vertical axis while Vk indicating an intercept of the straight line with the horizontal axis, the first condition is that a gradient of the straight line is greater than a reference gradient level and Vk is not greater than a reference level of Vk that is not greater than 0;

the second condition is that the gradient of the straight line is not greater than the reference gradient level and Vk is not greater than the reference level of Vk; and the third condition is that Vk is greater than the reference level of Vk.

8. The image forming apparatus according to claim 7, wherein if the first condition is satisfied, the controller executes the forced toner consumption control to forcibly consume a larger amount of toner in response to a greater difference between the gradient of the straight line and the reference gradient level.

9. The image forming apparatus according to claim 7, wherein if the first condition is satisfied, the controller executes the forced toner consumption control to forcibly consume a larger amount of toner in response to a greater difference between Vk and the reference level of Vk.

10. The image forming apparatus according to claim 1, wherein the controller does not execute the forced toner consumption control at the predetermined time when the developing bias as adjusted by the image density adjustment control is not lower than a predetermined level.

11. The image forming apparatus according to claim 1, further comprising:

a second latent image carrier to carry a latent image on a surface thereof;

a second developing device containing a two-component developer including toner and carrier, to develop the latent image with the toner to form a toner image on the surface of the second latent image carrier; and a cleaner for an intermediate transfer body or a recording medium conveyor, wherein the transfer unit includes the intermediate transfer body or the recording medium conveyor and transfers the toner images from the latent image carriers onto the intermediate transfer body or the recording medium carried by the recording medium conveyor while superimposing the toner images one atop another, and wherein the controller executes the forced toner consumption control of the second developing device by attaching the toner to the second latent image carrier to form a toner pattern on the surface of the second latent image carrier, the controller transfers the toner patterns from surfaces of the latent image carriers onto the intermediate transfer body or the recording medium conveyor, via the transfer unit, without superimposing the toner patterns one atop another, and the controller removes the toner patterns from the intermediate transfer body or the recording medium conveyor via the cleaner for the intermediate transfer body or the recording medium conveyor.

12. The image forming apparatus according to claim 11, wherein the controller simultaneously starts the forced toner consumption control of the developing devices.

13. The image forming apparatus according to claim 11, wherein the controller executes the forced toner consumption control so that the toner pattern formed on the surface of one of the latent image carriers is transferred onto the intermediate transfer body or the recording medium conveyor with a trailing end thereof continuous with a leading end of the toner pattern formed on the surface of the other latent image carrier previously transferred onto the intermediate transfer body or the recording medium conveyor.

14. The image forming apparatus according to claim 1, further comprising:

a second latent image carrier to carry a latent image on a surface thereof;

a second developing device containing a two-component developer including toner and a carrier, to develop the latent image with the toner to form a toner image on the surface of the second latent image carrier; and a plurality of cleaners for the latent image carriers, wherein the transfer unit includes an intermediate transfer body or a recording medium conveyor and transfers the toner images from the latent image carriers onto intermediate transfer body or the recording medium carried by the recording medium conveyor while superimposing the toner images one atop another, wherein the controller executes the forced toner consumption control of the second developing device by attaching the toner to the second latent image carrier to form a toner pattern on the surface of the second latent image carrier, the controller transfers some toner of the toner patterns from the surfaces of the latent image carriers onto the intermediate transfer body or the recording medium conveyor via the transfer unit, and the controller removes the some toner from the intermediate transfer body or the recording medium conveyor via a cleaner for the intermediate transfer body or the recording medium conveyor, while removing residual toner from the latent image carriers via the plurality of cleaners for the latent image carriers, and wherein the controller further executes an adjustment control of adjusting a ratio of an amount of the some toner and an amount of the residual toner.

15. The image forming apparatus according to claim 14, wherein the controller executes the adjustment control to adjust the ratio according to apparatus usage information.

* * * * *